US011484450B2

(12) United States Patent
Cutler et al.

(10) Patent No.: US 11,484,450 B2
(45) Date of Patent: Nov. 1, 2022

(54) PATIENT SUPPORT APPARATUS HAVING BEARING ARRANGEMENT FOR DECK EXTENSION ASSEMBLY

(71) Applicant: Stryker Corporation, Kalamazoo, MI (US)

(72) Inventors: Matthew A. Cutler, Portage, MI (US); David Scharich, III, Coloma, MI (US); Anish Paul, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 444 days.

(21) Appl. No.: 16/596,196

(22) Filed: Oct. 8, 2019

(65) Prior Publication Data

US 2020/0107982 A1 Apr. 9, 2020

Related U.S. Application Data

(60) Provisional application No. 62/742,673, filed on Oct. 8, 2018.

(51) Int. Cl.
*A61G 7/015* (2006.01)
*A61G 7/05* (2006.01)

(52) U.S. Cl.
CPC ..... *A61G 7/015* (2013.01); *A61G 7/0507* (2013.01)

(58) Field of Classification Search
CPC ..... A61G 7/015; A61G 13/129
See application file for complete search history.

(56) References Cited

U.S. PATENT DOCUMENTS 5,579,550 A 12/1996 Bathrick et al.
5,745,937 A 5/1998 Weismiller et al.
6,021,533 A 2/2000 Ellis et al.
6,071,579 A 6/2000 Green et al.
(Continued)

FOREIGN PATENT DOCUMENTS

AT 226411 T 11/2002
AT 463224 T 4/2010
(Continued)

OTHER PUBLICATIONS

Linet, "Photograph #1 of Bed Extender", 2018, 1 page.
(Continued)

*Primary Examiner* — Eric J Kurilla
(74) *Attorney, Agent, or Firm* — Howard & Howard Attorneys PLLC

(57) ABSTRACT

A patient support apparatus comprises a support frame and a patient support deck carried by the support frame. The patient support deck has a foot section configured to articulate relative to the support frame. A deck extension assembly comprises an extension frame and a deck extension section configured to extend and retract relative to the support frame. One more bearings are arranged between the deck extension section and the support frame. The deck extension section is movably coupled to the extension frame so that the deck extension section is able to move relative to the extension frame and relative to the foot section when the deck extension section extends and retracts relative to the support frame such that the deck extension section maintains contact with the bearing when extending and retracting relative to the support frame.

20 Claims, 15 Drawing Sheets

(56) References Cited

U.S. PATENT DOCUMENTS

| | | | | |
|---|---|---|---|---|
| 6,295,675 | B1 | 10/2001 | Ellis et al. | |
| 6,357,065 | B1 | 3/2002 | Adams | |
| 6,467,113 | B2 | 10/2002 | Ellis et al. | |
| 6,496,993 | B2 | 12/2002 | Allen et al. | |
| 6,611,979 | B2 | 9/2003 | Welling et al. | |
| 6,684,427 | B2 | 2/2004 | Allen et al. | |
| 6,760,939 | B2 | 7/2004 | Ellis et al. | |
| 6,880,189 | B2 | 4/2005 | Welling et al. | |
| 7,028,358 | B2 | 4/2006 | Liu | |
| 7,111,348 | B2 | 9/2006 | Ellis et al. | |
| 7,216,384 | B2 | 5/2007 | Allen et al. | |
| 7,260,860 | B2 | 8/2007 | Chambers et al. | |
| 7,353,556 | B2 | 4/2008 | Ellis et al. | |
| 7,363,663 | B2 | 4/2008 | Chambers et al. | |
| 7,398,573 | B2 | 7/2008 | Ellis et al. | |
| 7,461,425 | B2 | 12/2008 | Chambers et al. | |
| 7,464,425 | B2 | 12/2008 | Chambers et al. | |
| 7,533,429 | B2 | 5/2009 | Menkedick et al. | |
| 7,565,710 | B2 | 7/2009 | Chambers et al. | |
| 7,832,039 | B2 | 11/2010 | Chambers et al. | |
| 7,845,032 | B2 | 12/2010 | Chambers et al. | |
| 7,895,689 | B2 | 3/2011 | Hayes et al. | |
| 8,104,122 | B2 | 1/2012 | Richards et al. | |
| RE43,155 | E | 2/2012 | Allen et al. | |
| 8,122,546 | B2 | 2/2012 | Chambers et al. | |
| 8,452,508 | B2 * | 5/2013 | Frolik | B60B 33/0005 701/1 |
| 8,474,076 | B2 | 7/2013 | Hornbach | |
| 8,650,686 | B2 | 2/2014 | Biggie et al. | |
| 8,662,595 | B2 | 3/2014 | Kramer et al. | |
| 9,149,400 | B2 | 10/2015 | Serhan | |
| 10,188,569 | B2 | 1/2019 | Elku et al. | |
| 11,229,563 | B2 * | 1/2022 | Lacasse | A61G 7/018 |
| 2002/0029423 | A1 | 3/2002 | Ellis et al. | |
| 2003/0019042 | A1 | 1/2003 | Ellis et al. | |
| 2003/0145383 | A1 * | 8/2003 | Schwaegerle | A61G 13/04 5/610 |
| 2004/0261185 | A1 | 12/2004 | Ellis et al. | |
| 2006/0026767 | A1 | 2/2006 | Chambers et al. | |
| 2006/0026768 | A1 | 2/2006 | Chambers et al. | |
| 2007/0011817 | A1 | 1/2007 | Ellis et al. | |
| 2007/0017032 | A1 | 1/2007 | Ellis et al. | |
| 2007/0136949 | A1 | 6/2007 | Richards et al. | |
| 2008/0005847 | A1 | 1/2008 | Chambers et al. | |
| 2008/0005848 | A1 | 1/2008 | Chambers et al. | |
| 2008/0010752 | A1 | 1/2008 | Chambers et al. | |
| 2009/0070942 | A1 | 3/2009 | Chambers et al. | |
| 2009/0249552 | A1 | 10/2009 | Chambers et al. | |
| 2010/0257672 | A1 | 10/2010 | Poulos et al. | |
| 2011/0047709 | A1 | 3/2011 | Tarsaud et al. | |
| 2011/0099723 | A1 | 5/2011 | Chambers et al. | |
| 2011/0232001 | A1 | 9/2011 | Poulos et al. | |
| 2012/0073052 | A1 * | 3/2012 | Meyer | A61G 7/018 5/615 |
| 2012/0096644 | A1 | 4/2012 | Heimbrock | |
| 2014/0026325 | A1 | 1/2014 | Guthrie | |
| 2014/0047641 | A1 | 2/2014 | Thodupunuri et al. | |
| 2015/0128347 | A1 | 5/2015 | Hutchison et al. | |
| 2015/0290061 | A1 * | 10/2015 | Stafford | A63B 21/4047 5/600 |
| 2016/0143796 | A1 * | 5/2016 | Jordan | A61G 1/0275 701/70 |
| 2017/0071806 | A1 | 3/2017 | Graves et al. | |
| 2017/0325758 | A1 * | 11/2017 | Staudinger | A61G 13/129 |

FOREIGN PATENT DOCUMENTS

| | | | |
|---|---|---|---|
| AU | 8503598 | A | 3/1999 |
| AU | 8292998 | A | 8/1999 |
| BR | 9811375 | A | 8/2000 |
| CA | 2301609 | A1 | 3/1999 |
| CA | 2505097 | A1 | 9/2006 |
| CA | 2505101 | A1 | 9/2006 |
| DE | 69808941 | T2 | 2/2003 |
| EP | 1011391 | A1 | 6/2000 |
| EP | 1234565 | A2 | 8/2002 |
| EP | 1011391 | B1 | 10/2002 |
| EP | 1234565 | A3 | 12/2002 |
| EP | 1234565 | B1 | 4/2010 |
| EP | 2698137 | A1 | 2/2014 |
| EP | 2289477 | B1 | 9/2014 |
| EP | 2877058 | A1 | 6/2015 |
| EP | 2954884 | A1 | 12/2015 |
| EP | 3058923 | A1 | 8/2016 |
| JP | 2001513384 | A | 9/2001 |
| JP | 2016028675 | A | 3/2016 |
| TW | 279228 | B | 6/1996 |
| TW | 104829 | B | 9/2000 |
| WO | 9909865 | A1 | 3/1999 |
| WO | 9941537 | A1 | 8/1999 |
| WO | 2014201379 | A2 | 12/2014 |
| WO | 2014201379 | A3 | 2/2015 |

OTHER PUBLICATIONS

Linet, "Photograph #2 of Bed Extender", 2018, 1 page.
Linet, "Photograph #3 of Bed Extender", 2018, 1 page.
Linet, "Photograph #4 of Bed Extender", 2018, 1 page.
Linet, "Photograph #5 of Bed Extender", 2018, 1 page.
English language abstract for AT 226411 extracted from espacenet.com database on Feb. 13, 2019, 2 pages.
English language abstract for AT 463224 extracted from espacenet.com database on Feb. 13, 2019, 2 pages.
English language abstract for AU 8503598 extracted from espacenet.com database on Feb. 13, 2019, 2 pages.
English language abstract for AU 8292998 extracted from espacenet.com database on Feb. 13, 2019, 2 pages.
English language abstract for BR 9811375 extracted from espacenet.com database on Feb. 13, 2019, 2 pages.
English language abstract for DE 69 808 941 extracted from espacenet.com database on Feb. 13, 2019, 2 pages.
English language abstract for JP 2001-513384 extracted from espacenet.com database on Feb. 13, 2019, 2 pages.
English language abstract for JP 2016-028675 extracted from espacenet.com database on Feb. 13, 2019, 2 pages.
English language abstract for TW 279228 extracted from espacenet.com database on Feb. 13, 2019, 2 pages.
English language abstract for TW404829 extracted from espacenet.com database on Feb. 13, 2019, 2 pages.

* cited by examiner

PATIENT SUPPORT APPARATUS HAVING BEARING ARRANGEMENT FOR DECK EXTENSION ASSEMBLY

CROSS-REFERENCE TO RELATED APPLICATION

This application claims priority to and the benefit of U.S. Provisional Patent Application No. 62/742,673, filed on Oct. 8, 2018, which is hereby incorporated herein by reference in its entirety.

BACKGROUND

Patient support apparatuses facilitate care of patients in a health care setting. Patient support apparatuses include, for example, hospital beds, stretchers, cots, tables, wheelchairs, and chairs. A conventional patient support apparatus comprises a base, a support frame having a patient support surface, and a patient support deck carried by the support frame. The patient support deck often has several articulating deck sections to place the patient in various configurations for treatment and/or comfort.

Occasionally, the patient support apparatus additionally comprises a deck extension assembly having a deck extension section that is arranged to extend and retract relative to the support frame. The deck extension section can be extended, for example, when taller patients are on the patient support apparatus—to extend an overall length of the patient support surface. Usually the deck extension assembly comprises a pair of telescoping frame members that slide within a pair of support frame members. The deck extension section is fixed relative to the telescoping frame members and is arranged to slide along either an articulating foot section or the support frame. However, there may be high frictional forces that must be overcome when manually extending or retracting the deck extension section, which may make operation difficult for a caregiver.

A patient support apparatus with a deck extension assembly designed to overcome one or more of the aforementioned challenges is desired.

DETAILED DESCRIPTION

Figure 1:
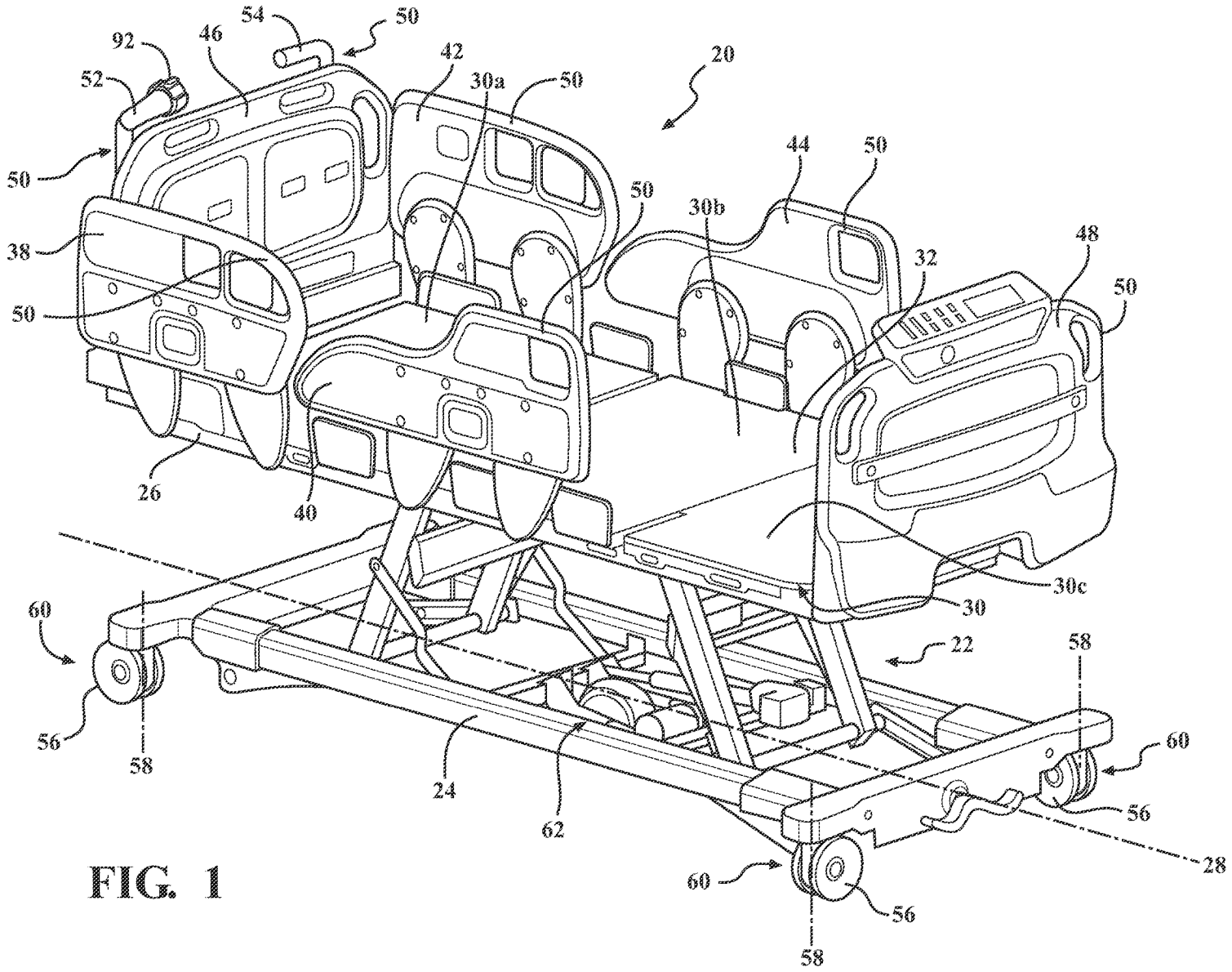
FIG. 1 is a perspective view of a patient support apparatus.

Referring to FIG. 1, a patient support apparatus 20 is shown for supporting a patient in a health care setting. The patient support apparatus 20 illustrated in FIG. 1 comprises a hospital bed. In other embodiments, however, the patient support apparatus 20 may comprise a cot, table, wheelchair, chair, or similar apparatus, utilized in the care of a patient.

A support structure 22 provides support for the patient. The support structure 22 illustrated in FIG. 1 comprises a base 24 and a support frame 26. The base 24 defines a longitudinal axis 28 from a head end to a foot end. The support frame 26 is spaced above the base 24. The support structure 22 also comprises a patient support deck 30 disposed on and carried by the support frame 26. The patient support deck 30 comprises several sections, some of which articulate (e.g., pivot) relative to the support frame 26, such as a back section 30*a*, a leg section 30*b*, and a foot section 30*c*. The patient support deck 30 provides a patient support surface 32 upon which the patient is supported.

A mattress, although not shown, may be disposed on the patient support deck 30. The mattress comprises a secondary patient support surface upon which the patient is supported. The base 24, support frame 26, patient support deck 30, and patient support surface 32 each have a head end and a foot end corresponding to designated placement of the patient's head and feet on the patient support apparatus 20. The construction of the support structure 22 may take on any known or conventional design, and is not limited to that specifically set forth above. In addition, the mattress may be omitted in certain embodiments, such that the patient rests directly on the patient support surface 32.

Side rails 38, 40, 42, 44 are supported by the base 24. A first side rail 38 is positioned at a right head end of the support frame 26. A second side rail 40 is positioned at a right foot end of the support frame 26. A third side rail 42 is positioned at a left head end of the support frame 26. A fourth side rail 44 is positioned at a left foot end of the support frame 26. If the patient support apparatus 20 is a stretcher, there may be fewer side rails. The first side rail 38 and the third side rail 42 may be mounted to the back section 30*a* to articulate with the back section 30*a*, while the second side rail 40 and the fourth side rail 44 are mounted to the support frame 26 to move with the support frame 26. Other arrangements are also possible. The side rails 38, 40, 42, 44 are movable between a raised position in which they block ingress and egress into and out of the patient support apparatus 20 and a lowered position in which they are not an obstacle to such ingress and egress. The side rails 38, 40, 42, 44 may also be movable to one or more intermediate positions between the raised position and the lowered position. In still other configurations, the patient support apparatus 20 may not comprise any side rails.

A headboard 46 and a footboard 48 are coupled to the support frame 26. In other embodiments, when the headboard 46 and footboard 48 are provided, the headboard 46 and footboard 48 may be coupled to other locations on the patient support apparatus 20, such as the base 24. In still other embodiments, the patient support apparatus 20 does not comprise the headboard 46 and/or the footboard 48.

User interfaces 50, such as handles, are shown integrated into the footboard 48 and side rails 38, 40, 42, 44 to facilitate movement of the patient support apparatus 20 over floor surfaces. Additional user interfaces 50 may be integrated into the headboard 46 and/or other components of the patient support apparatus 20. The user interfaces 50 are graspable by the user to manipulate the patient support apparatus 20 for movement.

Other forms of the user interface 50 are also contemplated. The user interface 50 may simply be a surface on the patient support apparatus 20 upon which the user logically applies force to cause movement of the patient support apparatus 20 in one or more directions, also referred to as a push location. This may comprise one or more surfaces on the support frame 26 or base 24. This could also comprise one or more surfaces on or adjacent to the headboard 46, footboard 48, and/or side rails 38, 40, 42, 44.

Support wheels 56 are coupled to the base 24 to support the base 24 on a floor surface such as a hospital floor. The support wheels 56 allow the patient support apparatus 20 to move in any direction along the floor surface by swiveling to assume a trailing orientation relative to a desired direction of movement. In the embodiment shown, the support wheels 56 comprise four support wheels each arranged in corners of the base 24. The support wheels 56 shown are caster wheels able to rotate and swivel about swivel axes 58 during transport. Each of the support wheels 56 forms part of a caster assembly 60. Each caster assembly 60 is mounted to the base 24. It should be understood that various configurations of the caster assemblies 60 are contemplated. In addition, in some embodiments, the support wheels 56 are not caster wheels and may be non-steerable, steerable, non-powered, powered, or combinations thereof. Additional support wheels 56 are also contemplated. A powered auxiliary wheel assembly may also be provided to transport the patient support apparatus 20 between locations.

Figure 2:
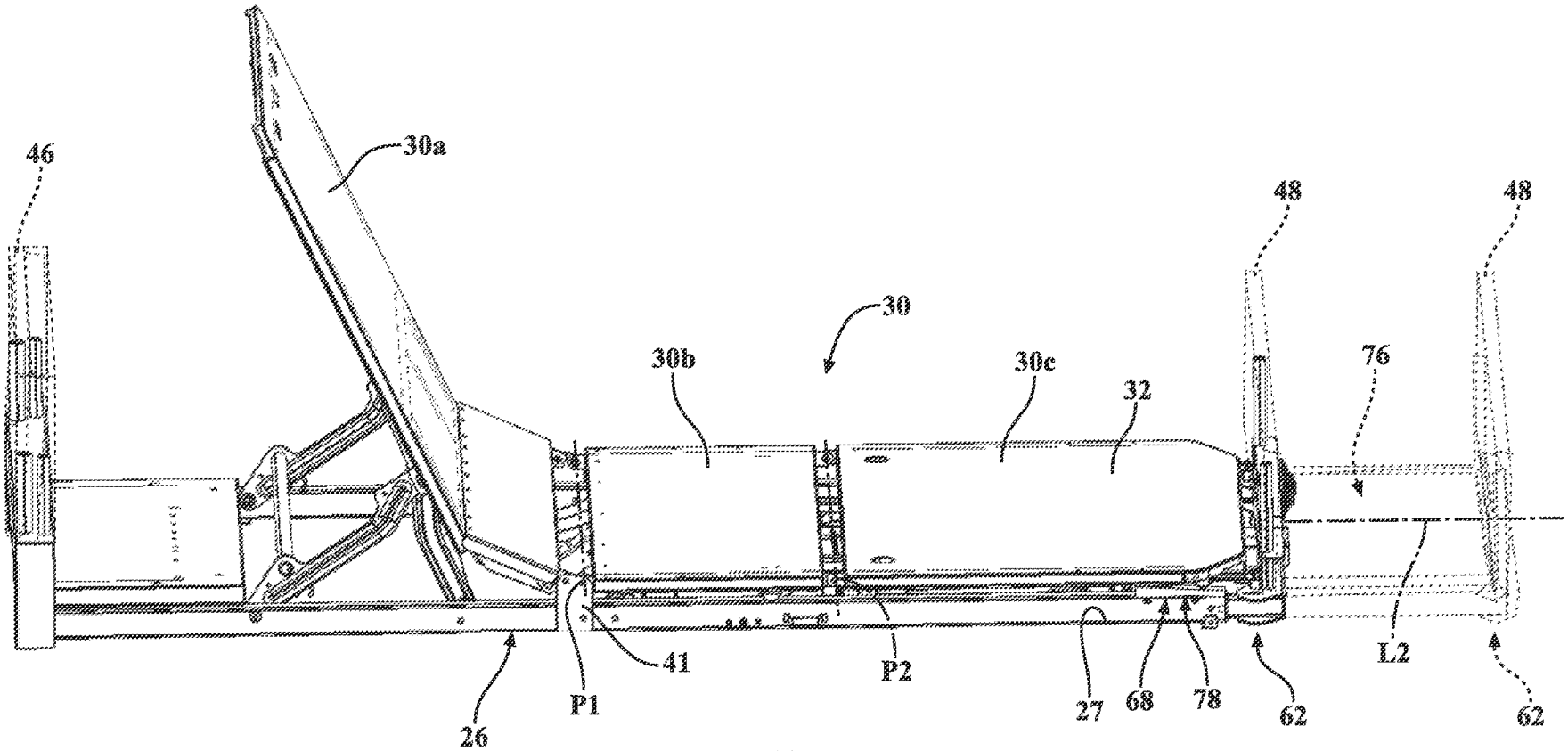
FIG. 2 is a perspective view of a support frame and patient support deck of the patient support apparatus of FIG. 1.

Referring to FIG. 2, the patient support deck 30 is shown supported and carried by the support frame 26. In particular, the deck sections 30*a*, 30*b*, 30*c* are shown in a configuration in which the back section 30*a* is raised above the support frame 26, the leg section 30*b* is in a lowered, horizontal position above the support frame 26, and the foot section 30*c* is in a lowered, horizontal position above the support frame 26.

The leg section 30*b* and the foot section 30*c* are pivotally coupled to each other and/or the support frame 26 at pivot joints defined about pivot axes P1, P2 as shown. Each of the deck sections 30*a*, 30*b*, 30*c* have a first end and a second end. It should be appreciated that the first and second ends are not necessarily the furthest extents of the deck sections, but refer generally to opposite portions of the deck sections. The first end is closer to the head end of the patient support apparatus 20 when the patient support deck 30 is in a flat configuration and the second end is closer to the foot end of the patient support apparatus 20 when the patient support deck 30 is in the flat configuration. In the embodiment shown, the first end of the leg section 30*b* is pivotally coupled to a bracket 41 fixed to the support frame 26 to pivot about the pivot axis P1. The first end of the foot section 30*c* is pivotally coupled to the second end of the leg section 30*b* to pivot about pivot axis P2. The leg section 30*b* and the foot section 30*c* may be pivotally coupled together by pivot pins, shafts, and the like at the pivot joints. Pivot brackets may be employed to form the pivot joints. Additionally, other types of connections are possible between the deck sections 30*a*, 30*b*, 30*c* so that the deck sections 30*a*, 30*b*, 30*c* are capable of moving, e.g., articulating, relative to one another. For instance, in some cases, translational joints may be provided between adjacent deck sections, or other compound movement connections may be provided between adjacent deck sections, such as joints that allow both pivotal and translational motion between adjacent deck sections.

Figure 3:
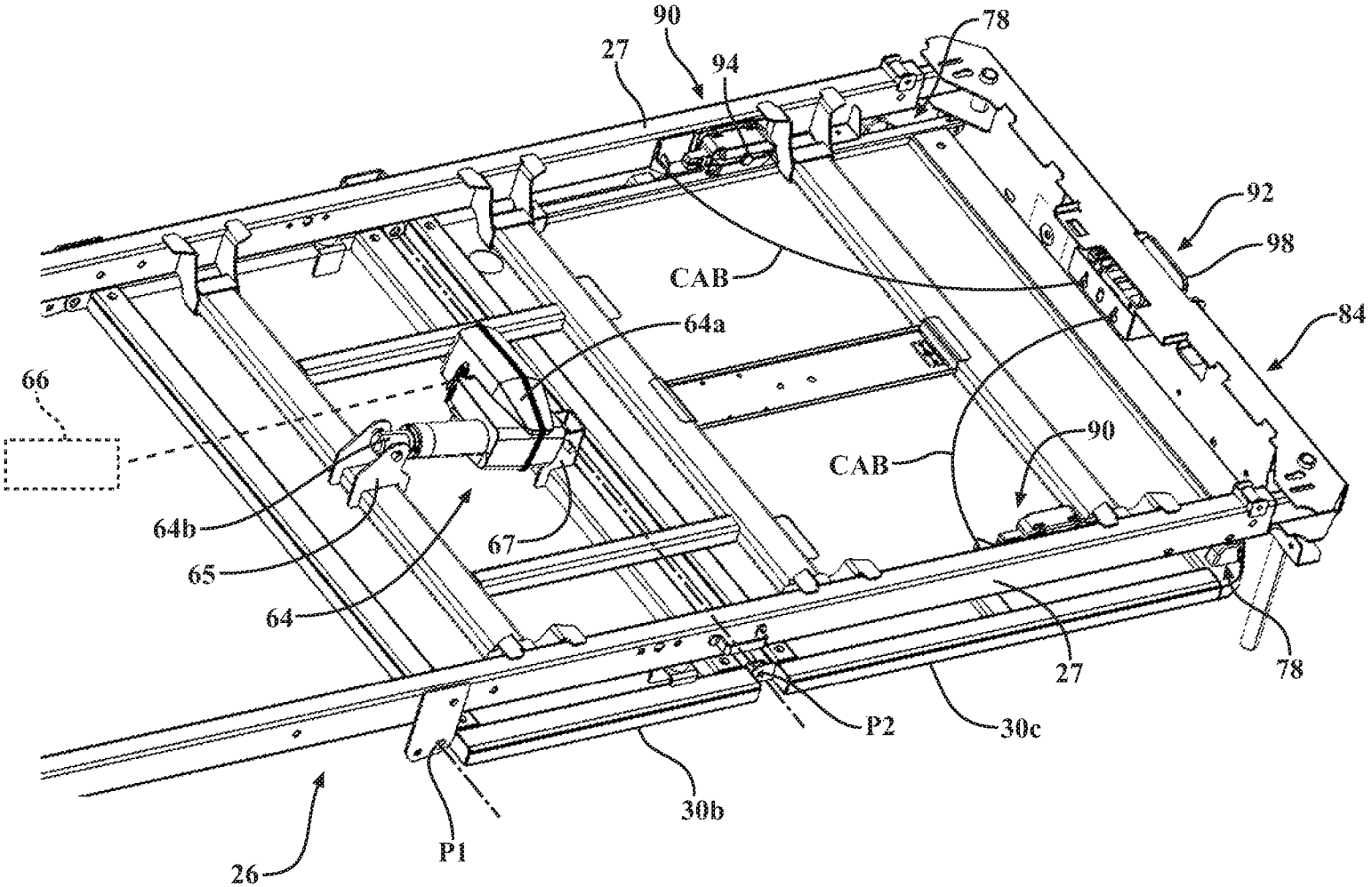
FIG. 3 is a bottom perspective view of a portion of the support frame and the patient support deck of FIG. 2.

Referring to FIG. 3, a leg section actuator 64 operates to move the leg section 30*b* and the foot section 30*c*. The leg section actuator 64 may be a linear actuator, rotary actuator, or other type of actuator capable of moving the leg section 30*b* and foot section 30*c*. The leg section actuator 64 may be electrically powered, hydraulic, electro-hydraulic, pneumatic, or the like. In the embodiment shown, the leg section actuator 64 is an electrically powered linear actuator comprising an actuator housing 64*a* and drive rod 64*b* that extends and retracts with respect to the actuator housing 64*a*.

The leg section actuator 64 is operatively connected to the leg section 30*b* to pivot, or otherwise articulate, the leg section 30*b* relative to the support frame 26 between the lowered position and one or more raised positions. More specifically, the leg section actuator 64 pivots the leg section 30*b* about pivot axis P1 relative to the support frame 26. Owing to the pivotal coupling of the second end of the leg section 30*b* to the first end of the foot section 30*c* at pivot axis P2, when the leg section 30*b* is moved, the first end of the foot section 30*c* is also moved. Thus, the leg section actuator 80 also operates to articulate the foot section 30*c* relative to the support frame 26 between the lowered position and one or more raised positions. In the embodiment shown, the leg section actuator 64 is pivotally connected at a first actuator end to a mounting bracket 65 fixed to the support frame 26. The leg section actuator 64 is pivotally connected at a second actuator end to a mounting bracket 67 fixed to the leg section 30*b*. The leg section actuator 64 could be pivotally connected to these brackets via pivot pins, shafts, and the like. In other embodiments, the leg section actuator 64 may be connected through other types of connections or linkages in order to move the leg section 30*b* to the lowered position or the one or more raised positions.

The leg section actuator 64 is operable to move the leg section 30*b* and the foot section 30*c* to different configurations. For example, the leg section 30*b* and foot section 30*c* may be placed in a flat configuration in which a patient would lie flat on the patient support deck 30 (see FIG. 4A). In this configuration, the leg section 30*b* and foot section 30*c* are aligned parallel to a second longitudinal axis L2 defined by the support frame 26. The leg section 30*b* and foot section 30*c* may also be placed in a raised configuration in which a patient's knee would be partially elevated (see FIG. 5B). To reach this configuration, the leg section actuator 64 has been operated to partially extend the drive rod 64*b* from the housing 64*a*.

A control system is provided to control operation of the actuator 64 (and other actuators not shown). The control system comprises a controller 66 (see FIG. 3) having one or more microprocessors for processing instructions or for processing an algorithm stored in memory to control operation of the actuator 64 (and other actuators not shown) to move the leg section 30*b* and the foot section 30*c*. Additionally or alternatively, the controller 66 may comprise one or more microcontrollers, field programmable gate arrays, systems on a chip, discrete circuitry, and/or other suitable hardware, software, or firmware that is capable of carrying out the functions described herein. The controller 66 may be carried on-board the patient support apparatus 20, or may be remotely located. In one embodiment, the controller 66 is mounted to the base 24. In other embodiments, the controller 66 is mounted to one or more of the support frame 26, the side rails 38, 40, 42, 44, the headboard 46, the footboard 48, or any other location. Power to the actuators and/or the controller 66 may be provided by a battery power supply or an external power source. The user, such as a caregiver, may actuate a user input device (not shown), which transmits a corresponding input signal to the controller 66, and the controller 66 controls operation of the actuator 64 based on the input signal.

Figure 4A:
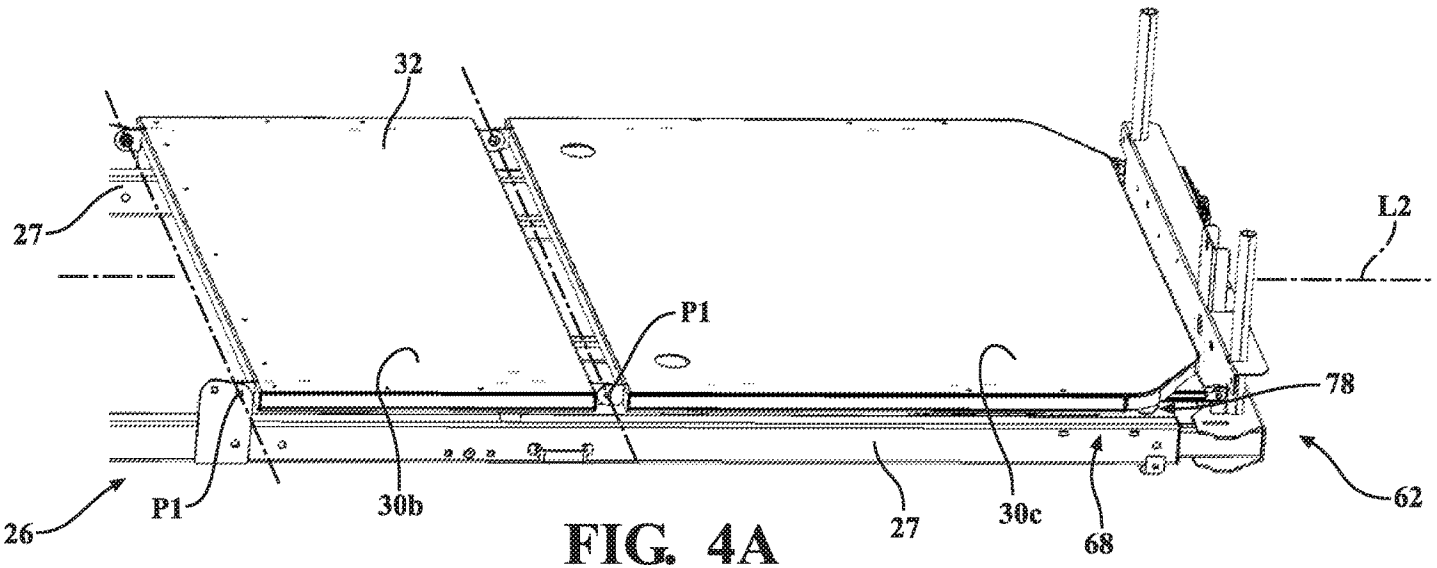
FIG. 4A is a top perspective view of a leg section and foot section of the patient support deck in a first configuration.
Figure 4B:
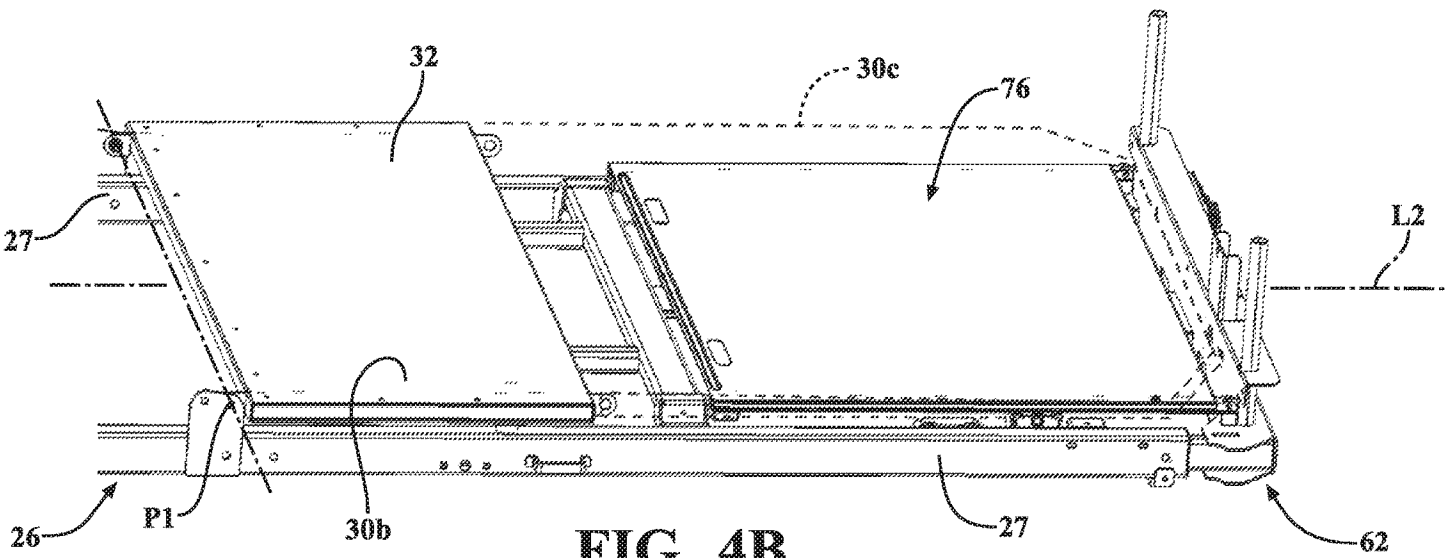
FIG. 4B is a top perspective view similar to FIG. 4, but with the foot section removed to show a deck extension section situated beneath the foot section.

Referring to FIGS. 4A and 4B, a deck extension assembly 62 is shown. The deck extension assembly 62 comprises a deck extension section 76 (see FIG. 4B). The deck extension assembly is provided to extend and retract relative to the support frame 26 to adjust an overall length of the patient support surface 32 that is available to support the patient. For example, when patients of different heights are using the patient support apparatus 20, the deck extension assembly 62 can be adjusted to accommodate such patients. Extension of the deck extension assembly 62 along the second longitudinal axis L2 is shown by broken lines in FIG. 2. When the deck extension assembly 62 is fully retracted, and the foot section 30*c* is in the lowered position, the deck extension section 76 is substantially disposed beneath the foot section 30*c* (compare FIGS. 4A and 4B—the foot section 30*c* has been hidden in FIG. 4B). However, when the deck extension assembly 62 is fully extended, as shown by broken lines in FIG. 2, the deck extension section 76 is extended out from beneath the foot section 30*c* to provide additional patient support surface.

Figure 5A:
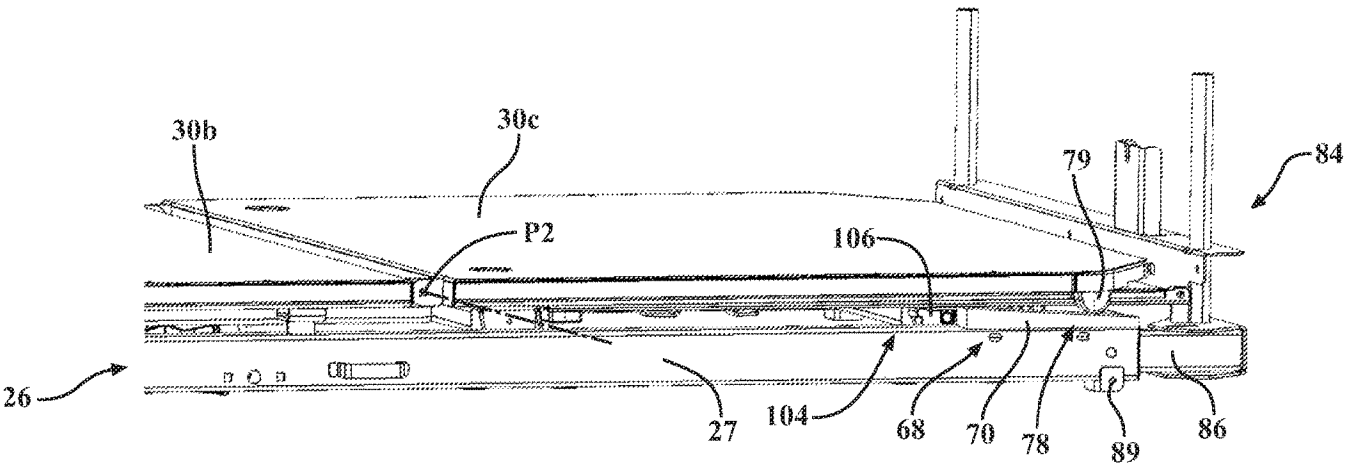
FIG. 5A is a top perspective view of the leg section and foot section of the patient support deck in the first configuration illustrating engagement of a slider and bearing in the first configuration.
Figure 5B:
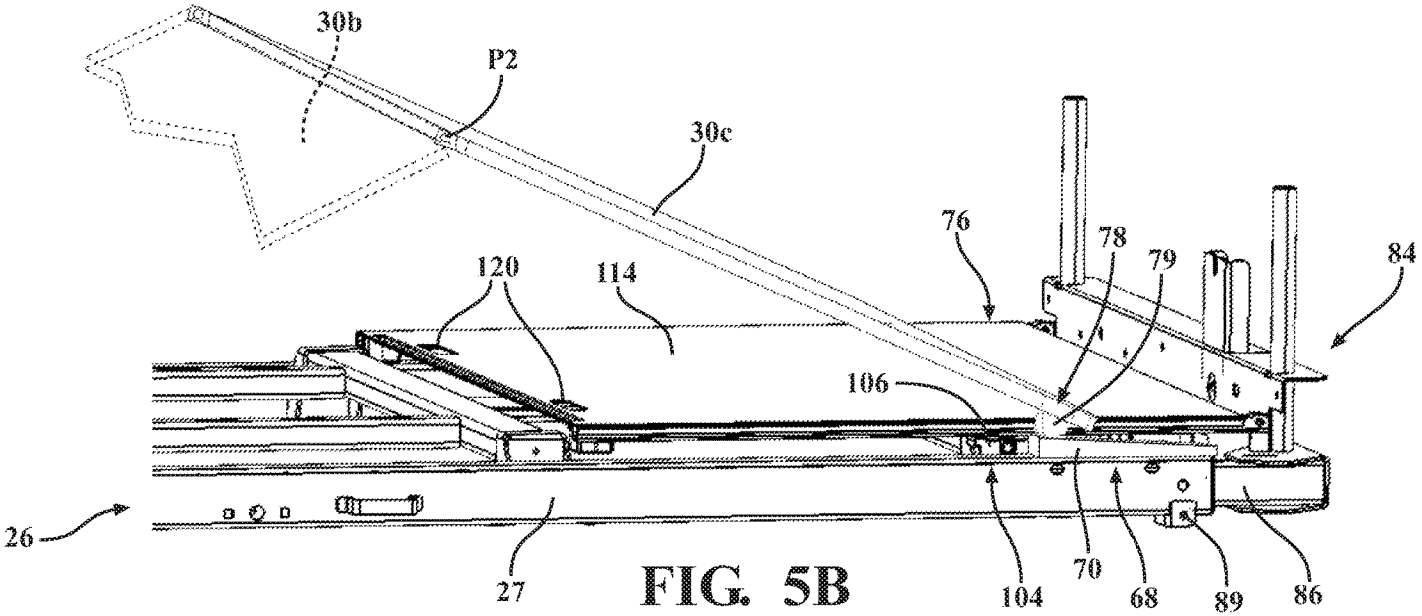
FIG. 5B is a top perspective view of the leg section and foot section of the patient support deck in a second configuration illustrating engagement of the slider and bearing in the second configuration.

Referring to FIGS. 5A and 5B, one or more bearings 68 are arranged to act between the foot section 30*c* and the support frame 26 when the foot section 30*c* articulates relative to the support frame 26. In the embodiment shown, the bearings 68 are mounted to the support frame 26 and are thereby fixed to the support frame 26. In other embodiments, the bearings 68 may be movable or fixed to another component of the patient support apparatus 20. In the embodiment shown, the second end of the foot section 30*c* is configured to slide along the bearings 68. One bearing 68 is shown in FIGS. 5A and 5B, but a similar bearing 68 is present on an opposite side of the support frame 26.

Each of the bearings 68 comprise a bearing block 70 formed at least partially of plastic. For instance, the bearing blocks 70 may be formed of polyamides or nylon, high-density polyethylene (HDPE), low-density polyethylene (LDPE), polyethylene terephthalate (PET), polypropylene (PP), high impact polystyrene (HIPS), polyvinyl chloride (PVC), polytetrafluoroethylene (PTFE), combinations thereof, or other suitable plastic materials. The bearing blocks 70 may also be formed of other materials, such as metal, combinations of metal and plastic, etc. The bearing blocks 70 are fixed to the support frame 26 via one or more fasteners, adhesive, welding, or the like to be spaced from each other on opposing support frame members 27 of the support frame 26. The bearing blocks 70 may further be coated with low friction coatings to reducing frictional forces between the bearing blocks 70 and the foot section 30*c*, such as a polytetrafluoroethylene (PTFE) coating or other suitable low friction coating.

Figure 6:
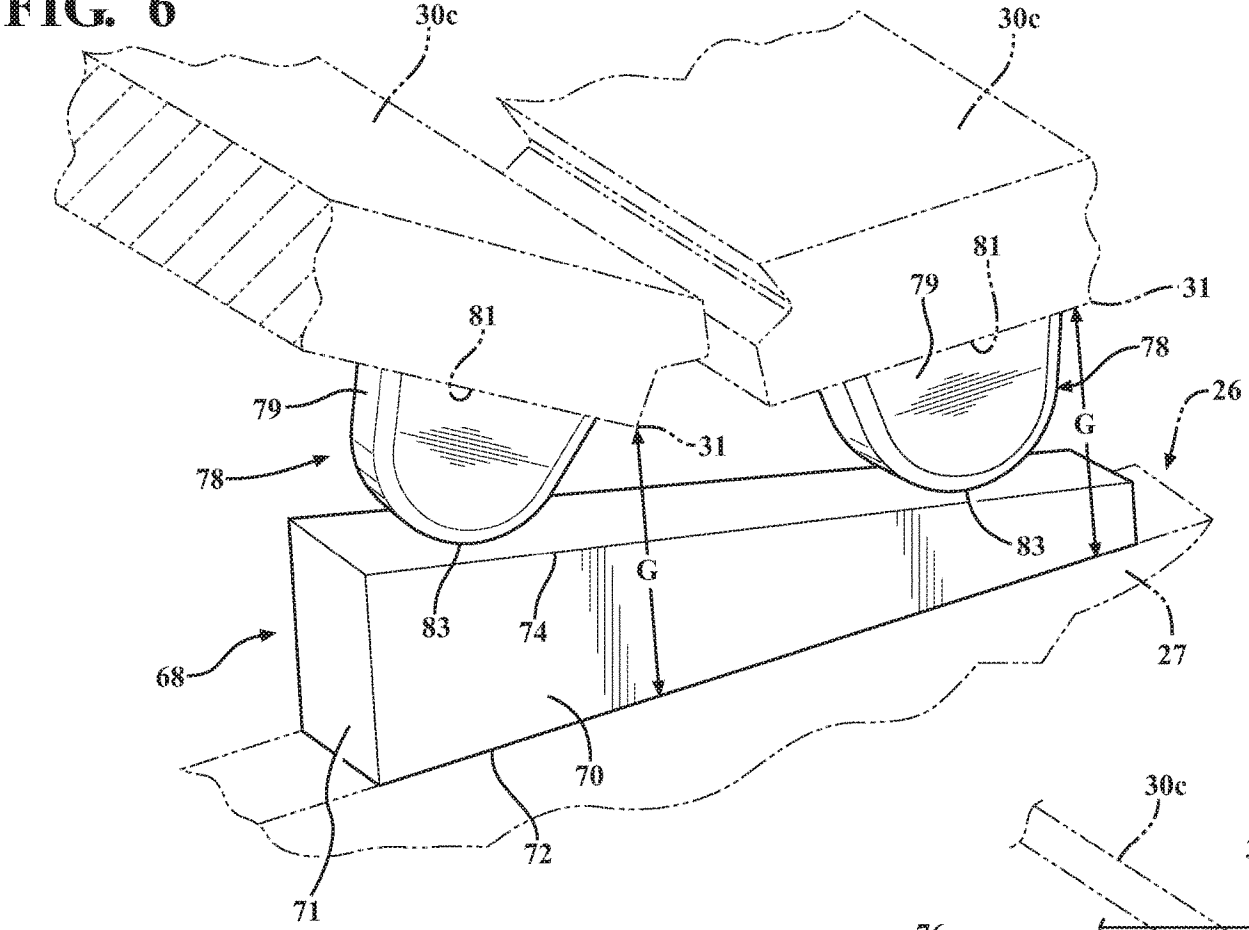
FIG. 6 is a perspective view illustrating engagement of the slider and bearing.
Figure 6A:
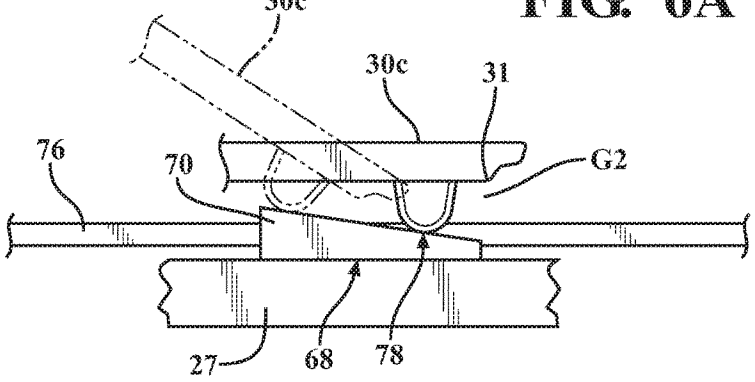
FIG. 6A is an illustration of a gap between a bottom edge of the foot section and a top surface of the deck extension section.

Referring to FIG. 6, which illustrates articulation of the foot section 30*c*, the foot section 30*c* comprises one or more sliders 78 that slide along the bearing blocks 70. More specifically, each of the bearing blocks 70 comprises a base portion 72 and a ramped portion 74. Each slider 78 is configured to slide along the ramped portion 74 when the foot section 30*c* articulates relative to the support frame 26. The ramped portion 74 has an upper surface profile that increases in height from foot end to head end to maintain a gap G between the foot section 30*c* and the support frame members 27 of the support frame 26 as the foot section 30*c* articulates relative to the support frame 26, even though a bottom edge 31 of the foot section 30*c* is tilting downward toward the support frame members 27 during such articulation. By virtue of this gap G, spacing (see gap G2 in FIG. 6A) can be maintained between the foot section 30*c* and a top surface of the deck extension section 76 of the deck extension assembly 62, while the foot section 30*c* articulates relative to the support frame 26. Such spacing facilitates easier sliding of the deck extension assembly 62 relative to the support frame 26. For example, in the embodiment shown, the deck extension assembly 62 can be extended/retracted with the same force regardless of a patient's weight on the foot section 30*c*, since the patient's weight on the foot section 30*c* is transmitted to the support frame 26 and not to the deck extension assembly 62. The upper surface profile may be an inclined surface with constant rise, or may be curved in shape, or any other shape suitable to maintain the described spacing. In some cases, referring to FIG. 6A, the gap G2 between the bottom edge 31 of the foot section 30*c* and the top surface of the deck extension section 76 may be constant at all articulation angles of the foot section 30*c*, or may vary at different articulation angles. Other shapes of the bearing blocks 70 are also contemplated.

Figure 7:
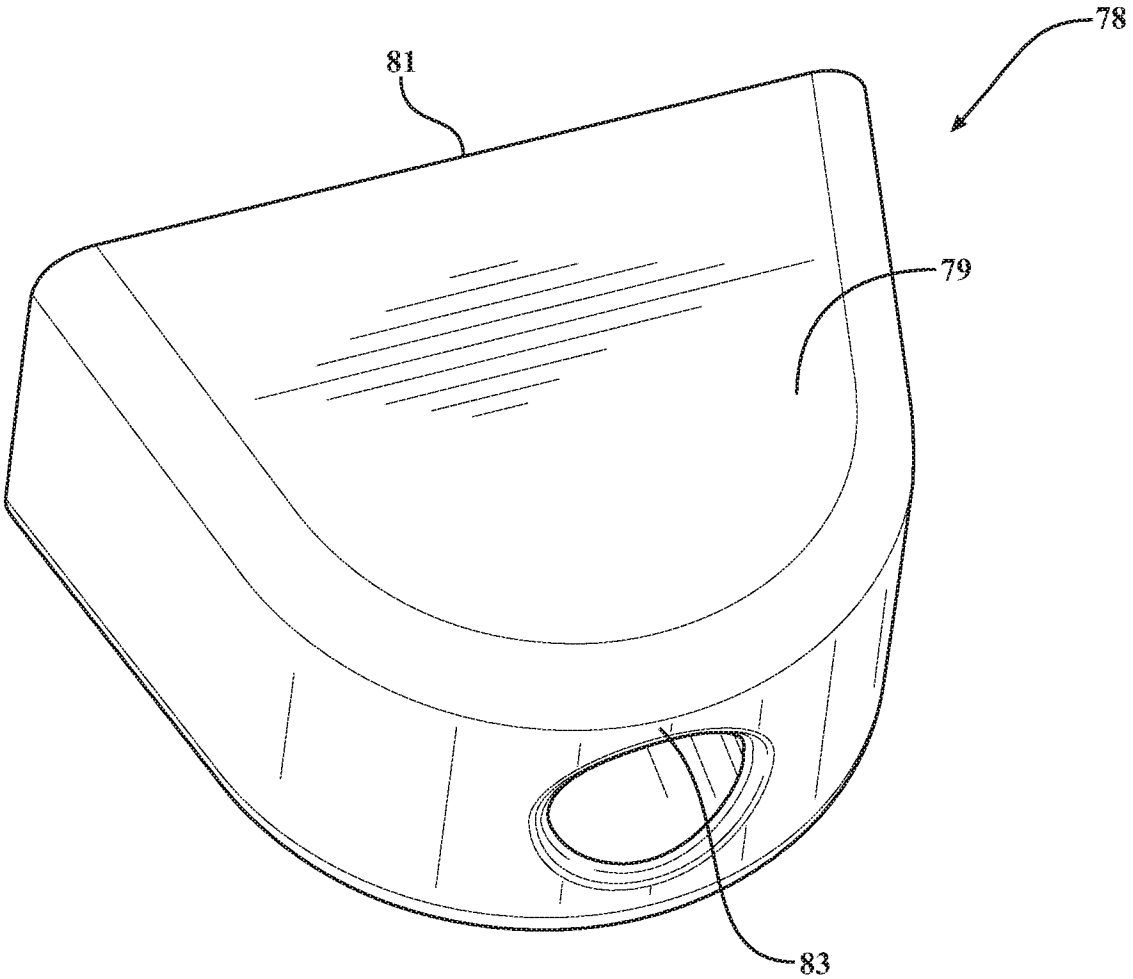
FIG. 7 is a perspective view of the slider.

Referring to FIG. 7, the sliders 78, which may comprise slider blocks 79, are formed at least partially of plastic. For instance, the slider blocks 79 may be formed of polyamides or nylon, high-density polyethylene (HDPE), low-density polyethylene (LDPE), polyethylene terephthalate (PET), polypropylene (PP), high impact polystyrene (HIPS), polyvinyl chloride (PVC), polytetrafluoroethylene (PTFE), combinations thereof, or other suitable plastic materials. The slider blocks 79 may also be formed of other materials, such as metal, combinations of metal and plastic, etc.

Figure 8:
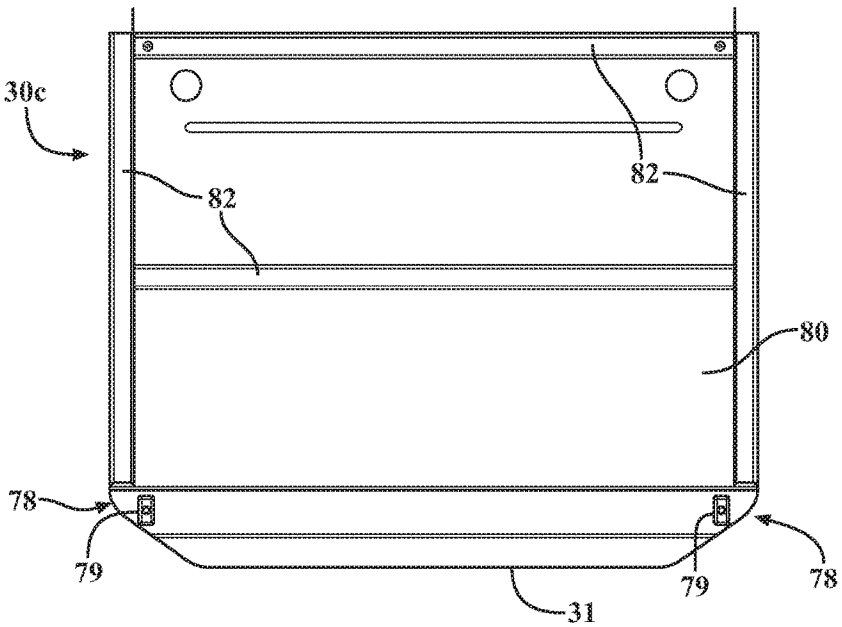
FIG. 8 is a bottom view of the foot section.
Figure 9:
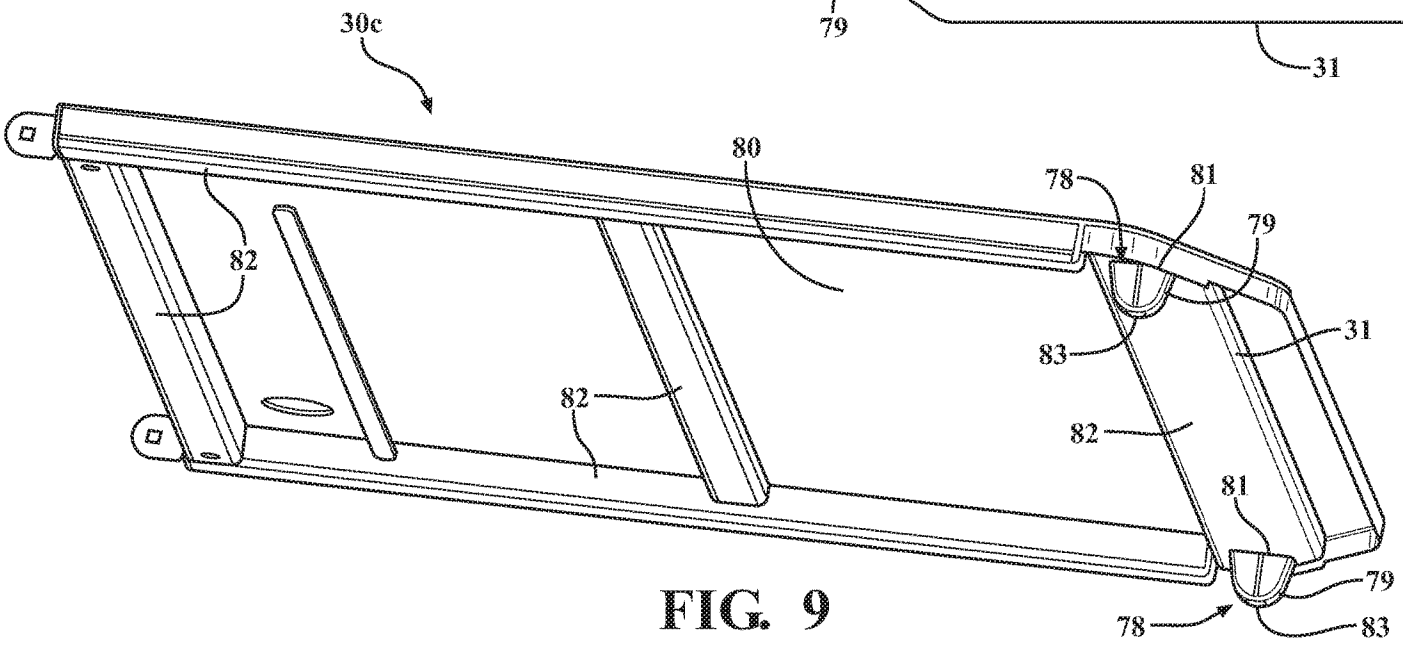
FIG. 9 is a bottom perspective view of the foot section.

As shown in FIGS. 8 and 9, the foot section 30*c* comprises a foot section panel 80 fixed to a foot section frame 82, such as by fasteners, adhesive, welding, etc. The slider blocks 79 are fixed to the foot section frame 82 via one or more fasteners, adhesive, welding, or the like to be spaced from each other on opposing sides of the foot section 30*c*. The slider blocks 79 may further be coated with low friction coatings to reducing frictional forces between the slider blocks 79 and the bearing blocks 70, such as a polytetrafluoroethylene (PTFE) coating or other suitable low friction coating. The slider blocks 79 may have a base portion 81 fixed to the foot section frame 82 and an arcuate contact portion 83 shaped to contact the bearing blocks 70. Other shapes of the slider blocks 79 are also contemplated.

Figure 10:
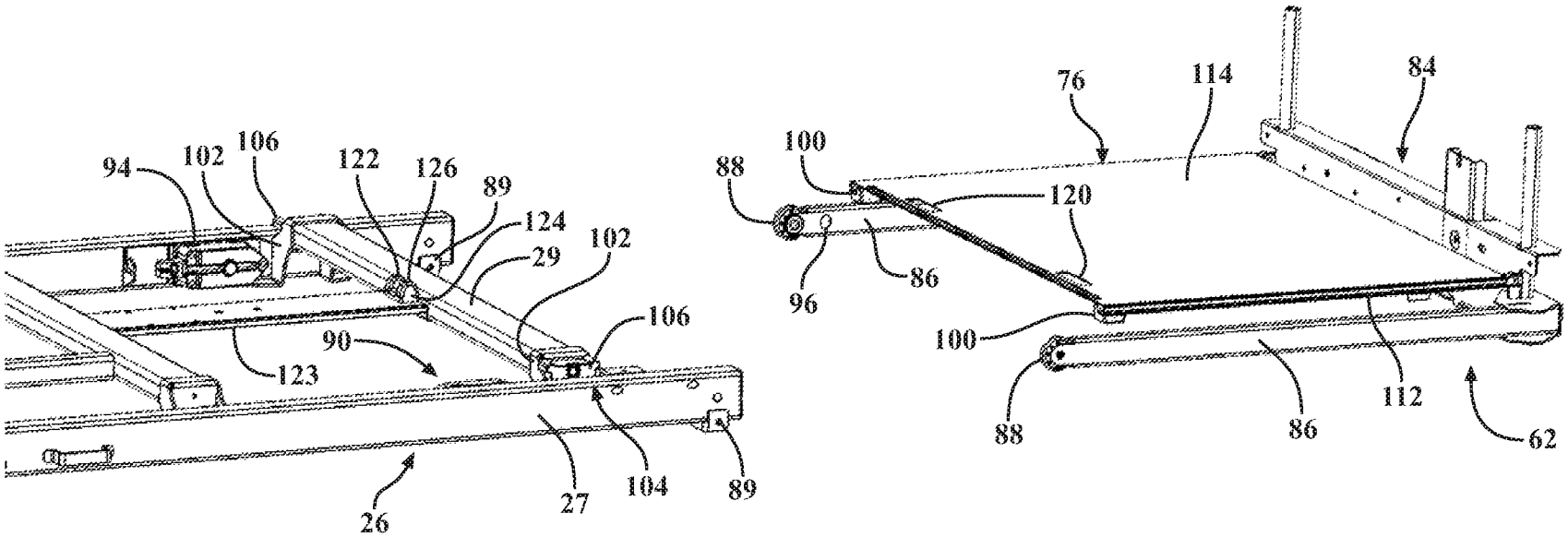
FIG. 10 is an exploded perspective view of a portion of the support frame and a deck extension assembly.
Figure 11:
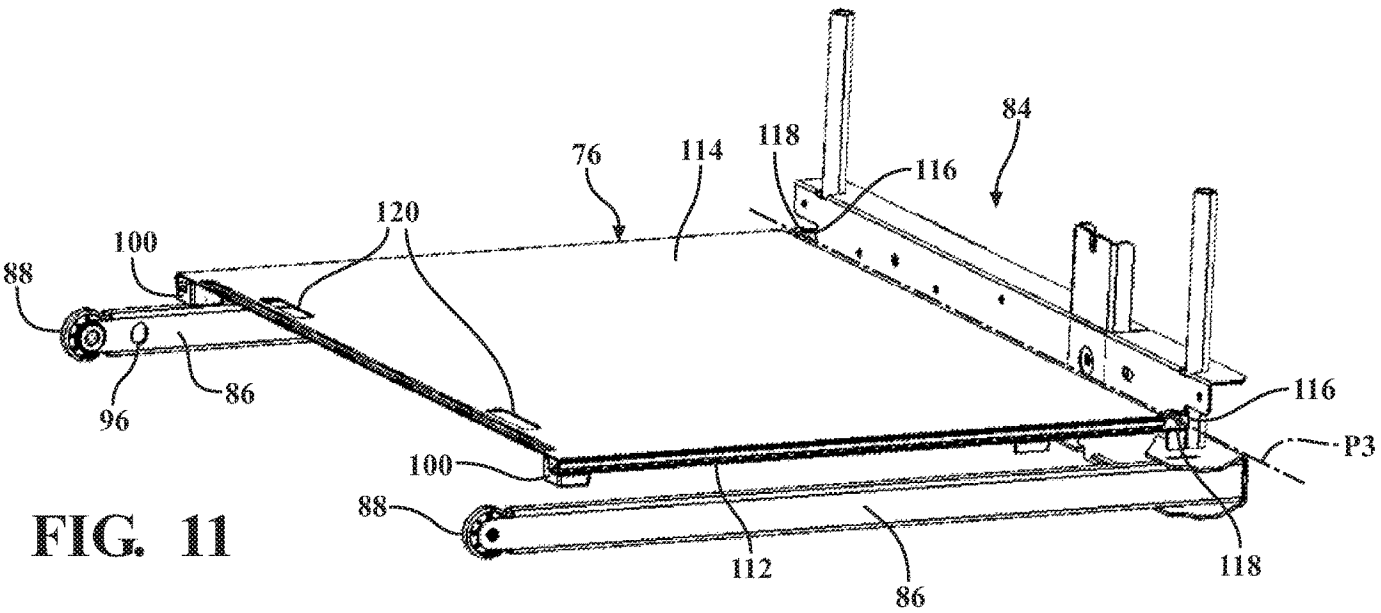
FIG. 11 is a top perspective view of the deck extension assembly.
Figure 12:
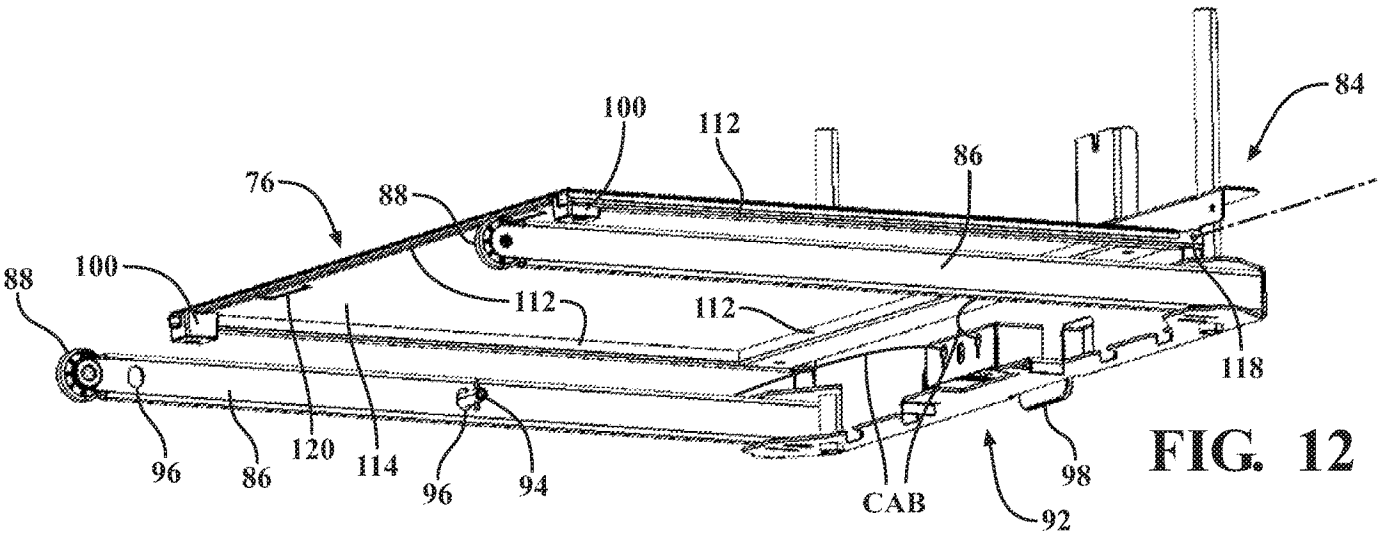
FIG. 12 is a bottom perspective view of the deck extension assembly.

Referring to FIGS. 10-12, the deck extension assembly 62 further comprises an extension frame 84. The extension frame 84 and the deck extension section 76 are configured to extend and retract relative to the support frame 26. The deck extension assembly 62 comprises a pair of telescoping frame members 86 fixed to and extending from the extension frame 84. The telescoping frame members 86 are vertically spaced from the deck extension section 76. The support frame members 27 are arranged to slidably receive the pair of telescoping frame members 86. One or more rollers 88 may be rotatably connected to the telescoping frame members 86 to ease sliding of the telescoping frame members 86 into the support frame members 27. One or more additional rollers 89 may be rotatably connected to the support frame members 27 to support the telescoping frame members 86 when sliding relative to the support frame members 27. In one version, the additional rollers 89 partially protrude into the support frame members 27 such that the telescoping frame members 86 are fully supported in the support frame members 27 by the rollers 88 and 89, i.e., top/bottom walls of the telescoping frame members 86 remain spaced from top/bottom walls of the support frame members 27. This reduces frictional contact between the telescoping frame members 86 and the support frame members 27.

One or more locking mechanisms 90 are configured to lock the deck extension assembly 62 from extending or retracting relative to the support frame 26. In the version shown, the locking mechanisms 90 are mounted to the support frame 26, but other variations are contemplated. A release mechanism 92 (see FIG. 12) is configured to actuate the locking mechanisms 90 to unlock the deck extension assembly 62. The locking mechanisms 90 may comprise one or more locking elements 94 (see FIGS. 10 and 12) that are arranged to engage discrete openings 96 in the telescoping frame members 86 to lock the telescoping frame members 86 at discrete positions. The release mechanism 92 comprises a handle 98 and one or more cables CAB (see also FIG. 3) that are connected to the locking mechanisms 90 to release the locking elements 94 by pulling the locking elements 94 out of the openings 96 to allow relative sliding between the telescoping frame members 86 and the support frame member 27. One example of suitable locking mechanisms and a suitable release mechanism that may be employed is shown, for example, in U.S. Patent Application Publication No. 2017/0071806, filed on Sep. 9, 2016, entitled "Telescoping Assembly for use on a Patient Support Apparatus," which is hereby incorporated herein by reference.

The deck extension section 76 comprises one or more stops 100 arranged to contact the support frame 26 when the deck extension section 76 is fully extended away from the support frame 26. For example, as shown in FIG. 13, the stops 100 are located to contact frame brackets 102 of the support frame 26 to prevent the deck extension section 76 from being fully removed, i.e., preventing the telescoping frame members 86 from being fully pulled out of the support frame members 27.

Figure 13:
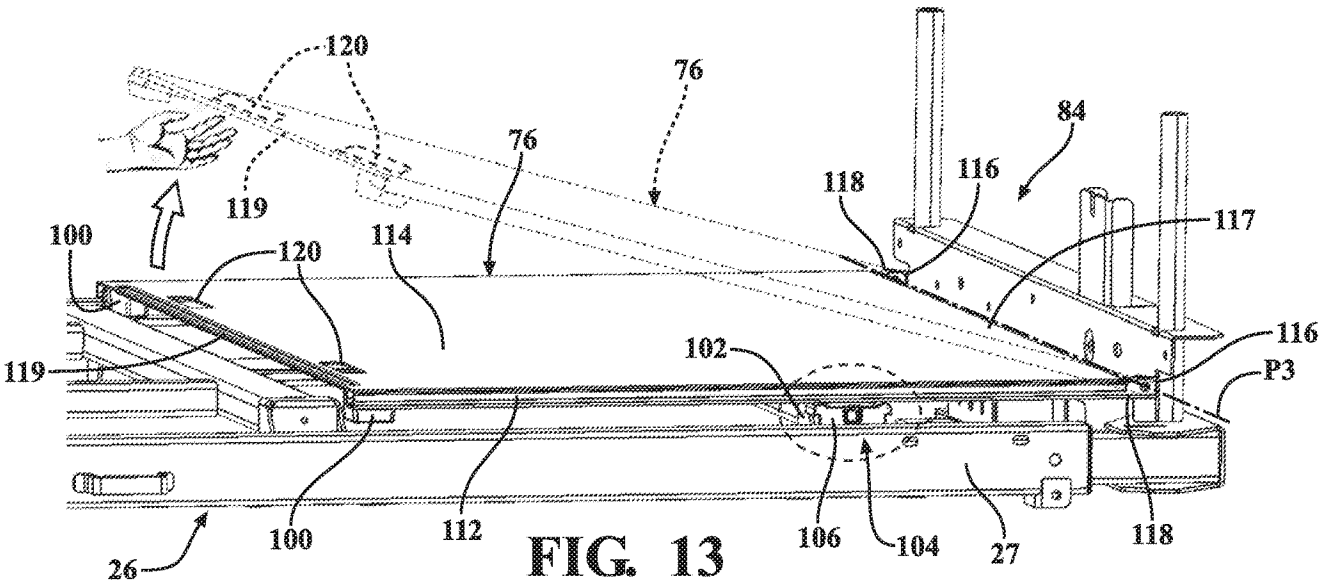
FIG. 13 is a top perspective view of the deck extension section illustrating articulation of the deck extension section.
Figure 14:
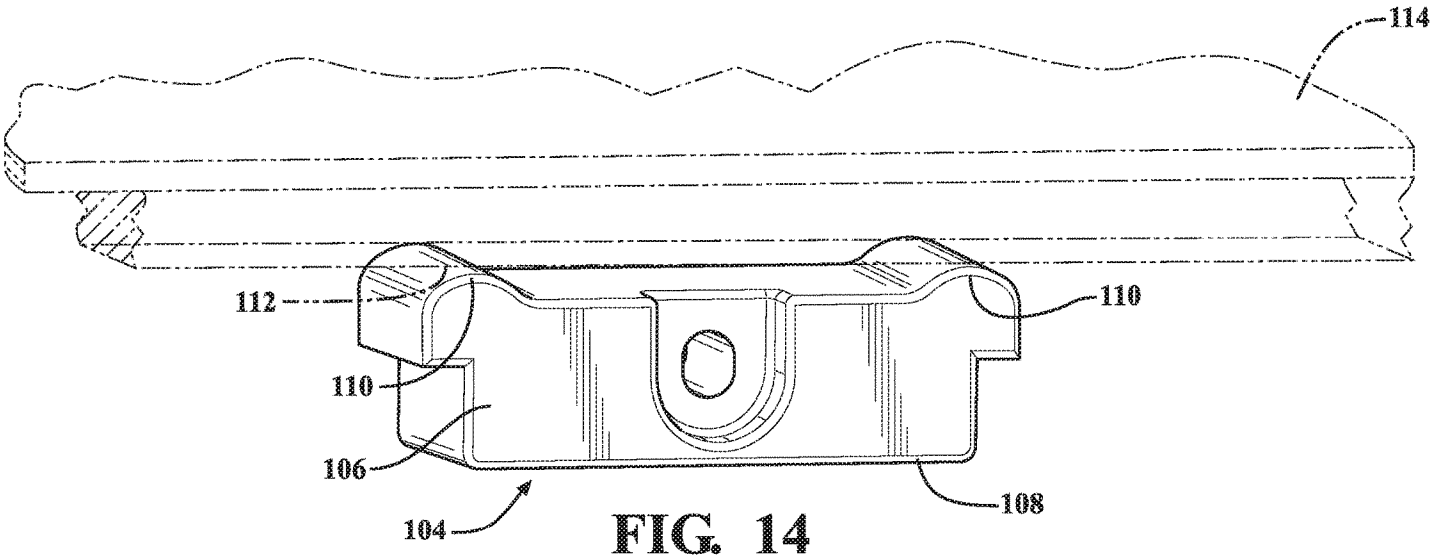
FIG. 14 is a top perspective view of another bearing that supports the deck extension section.
Figure 15:
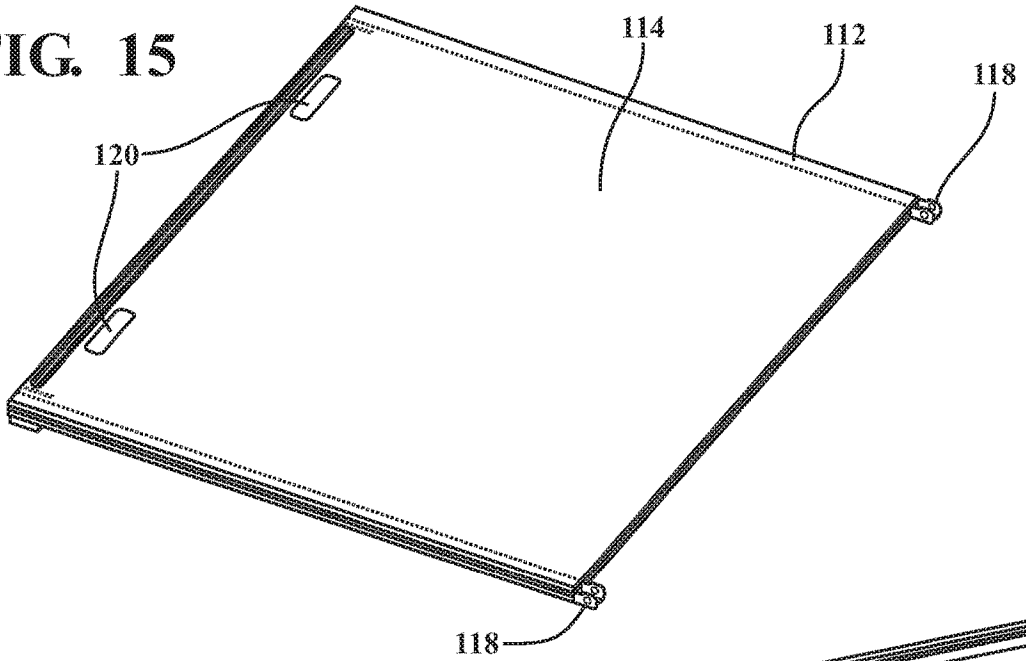
FIG. 15 is a top perspective view of the deck extension section.
Figure 16:
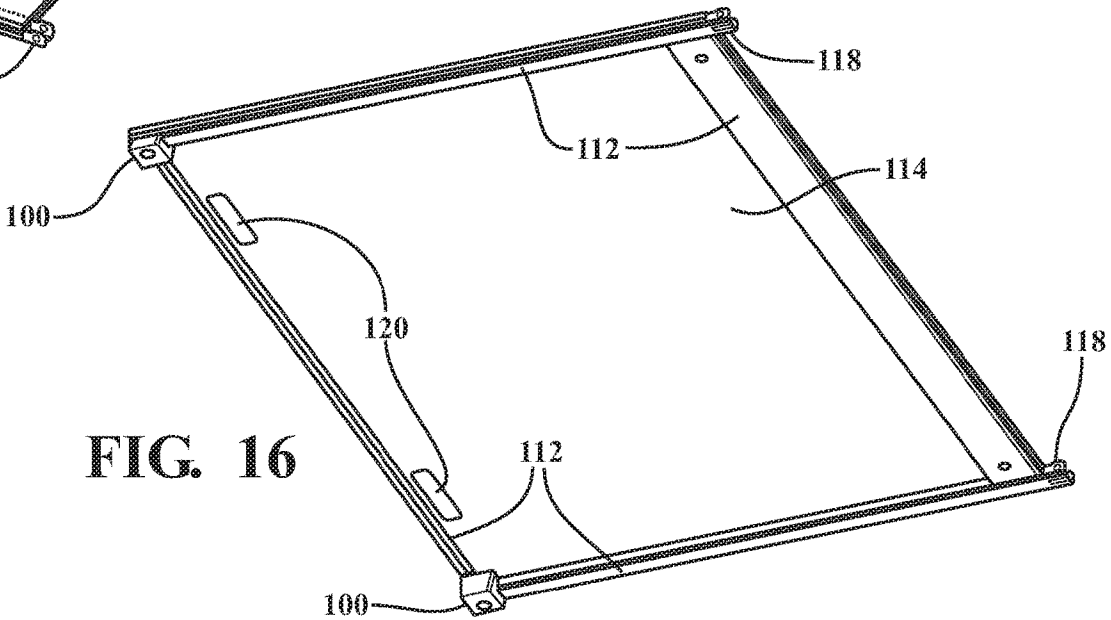
FIG. 16 is a bottom perspective view of the deck extension section.

Referring to FIGS. 13 and 14, one or more bearings 104 are arranged to act between the deck extension section 76 and the support frame 26 when the deck extension section 76 extends and retracts relative to the support frame 26. In the embodiment shown, the bearings 104 are mounted to the support frame 26 (e.g., connected to cross member 29 as shown in FIG. 10) and are thereby fixed to the support frame 26. In other embodiments, the bearings 104 may be movable or fixed to another component of the patient support apparatus 20. In the embodiment shown, a bottom surface of the deck extension section 76 is configured to slide along the bearings 104. One bearing 104 is shown in FIG. 13, but a similar bearing 104 is present on an opposite side of the support frame 26.

Each of the bearings 104 comprise a bearing block 106 formed at least partially of plastic. For instance, the bearing blocks 106 may be formed of polyamides or nylon, high-density polyethylene (HDPE), low-density polyethylene (LDPE), polyethylene terephthalate (PET), polypropylene (PP), high impact polystyrene (HIPS), polyvinyl chloride (PVC), polytetrafluoroethylene (PTFE), combinations thereof, or other suitable plastic materials. The bearing blocks 106 may also be formed of other materials, such as metal, combinations of metal and plastic, etc. The bearing blocks 106 are fixed to the support frame 26 via one or more fasteners, adhesive, welding, or the like to be spaced from each other on opposing support frame members 27 of the support frame 26. The bearing blocks 106 may further be coated with low friction coatings to reducing frictional forces between the bearing blocks 106 and the deck extension section 76, such as a polytetrafluoroethylene (PTFE) coating or other suitable low friction coating. As shown in FIG. 14, each of the bearing blocks 106 comprises a base portion 108 and one or more arcuate contact portions 110 shaped to engage the deck extension section 76. Other shapes of the bearing blocks 106 are also contemplated.

The deck extension section 76 comprises a panel frame 112 and an extension panel 114 mounted to the panel frame 112. The bearing blocks 106 are arranged to contact the panel frame 112 as the deck extension section 76 extends and retracts relative to the support frame 26.

The deck extension section 76 is movably coupled to the extension frame 84 to move relative to the extension frame 84 and relative to the foot section 30*c* when the deck extension section 76 extends and retracts relative to the support frame 26. More specifically, the deck extension section 76 is pivotally connected to the extension frame 84 to be able to pivot relative to the extension frame 84 about pivot axis P3 as the deck extension section 76 extends and retracts relative to the support frame 26. In the version shown, the extension frame 84 comprises a pair of pivot brackets 116 and the deck extension section 76 comprises a corresponding pair of pivot brackets 118 pivotally connected to the pivot brackets 116 via pivot pins, shafts, and the like to form pivot joints. In other embodiments, the deck extension section 76 may be connected through other types of connections or linkages in order to allow movement of the deck extension section 76.

A foot end 117 of the deck extension section 76 (see FIG. 13) is supported by virtue of the pivot joints, and a head end 119 of the deck extension section 76 is free to pivot. The bearing blocks 106 are located to support the deck extension section 76 between the head end 119 and foot end 117 during sliding of the deck extension section 76. More specifically, the deck extension section 76 is able to maintain contact with the bearing blocks 106 when extending and retracting relative to the support frame 26 owing to the free end of the deck extension section 76 being generally unsupported, i.e., other than the pivot joints, the bearing blocks 106 provide the primary support to the deck extension section 76. When a user, such as a caregiver, extends or retracts the deck extension assembly 62, such as by pulling or pushing on the extension frame 84, the deck extension section 76 is able to smoothly ride along the bearing blocks 106 owing to the deck extension section 76 being able to rise and fall by virtue of its free head end 119 and its pivot connection to the extension frame 84. This makes it easier for the user to extend and retract the deck extension assembly 62 than if the deck extension section were rigidly fixed to the extension frame 84. Of course, there may be such a rigidly fixed connection in certain embodiments.

The deck extension section 76 comprises one or more handles 120 to manually pivot the deck extension section 76 relative to the extension frame 84. This may facilitate cleaning and/or servicing of the patient support apparatus 20. Such pivoting for purposes of cleaning/servicing is shown by broken lines in FIG. 13.

Referring briefly back to FIG. 10, another bearing block 122 may be coupled to the support frame 26 (e.g., three bearing blocks 106, 122 are present in the illustrated embodiment). The bearing block 122 may be arranged to contact the extension panel 114 as the deck extension section 76 extends and retracts relative to the support frame 26. The bearing block 122 acts in concert with the bearing blocks 106 to support the deck extension section 76 by supporting the extension panel 114, while the bearing blocks 106 support the panel frame 112.

The bearing block 122 may be formed at least partially of plastic. For instance, the bearing block 122 may be formed of polyamides or nylon, high-density polyethylene (HDPE), low-density polyethylene (LDPE), polyethylene terephthalate (PET), polypropylene (PP), high impact polystyrene (HIPS), polyvinyl chloride (PVC), polytetrafluoroethylene (PTFE), combinations thereof, or other suitable plastic materials. The bearing block 122 may also be formed of other materials, such as metal, combinations of metal and plastic, etc. The bearing block 122 is fixed to the support frame 26 (e.g., to member 123) via one or more fasteners, adhesive, welding, or the like. The bearing block 122 may further be coated with low friction coatings to reducing frictional forces between the bearing block 122 and the deck extension section 76, such as a polytetrafluoroethylene (PTFE) coating or other suitable low friction coating. The bearing block 122 comprises a base portion 124 and one or more arcuate contact portions 126 shaped to engage the deck extension section 76. Other shapes of the bearing block 122 are also contemplated.

Figure 17:
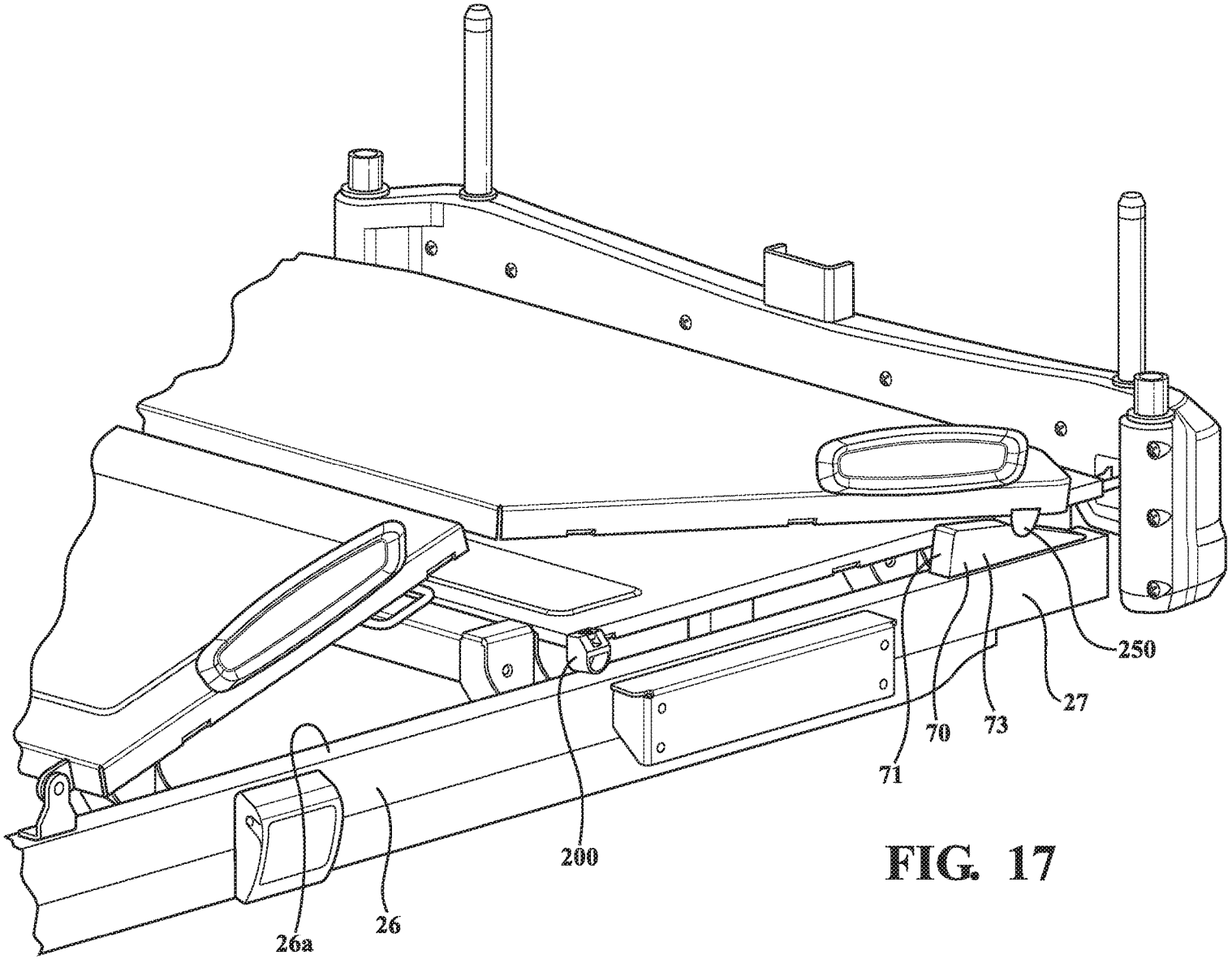
FIG. 17 is a side perspective view of the leg section and foot section of another embodiment of the patient support apparatus in a partially raised configuration including a slider bearing positioned on an upper surface of the support member and including a shield member covering the slider and bearing block of the bearing.
Figure 19:
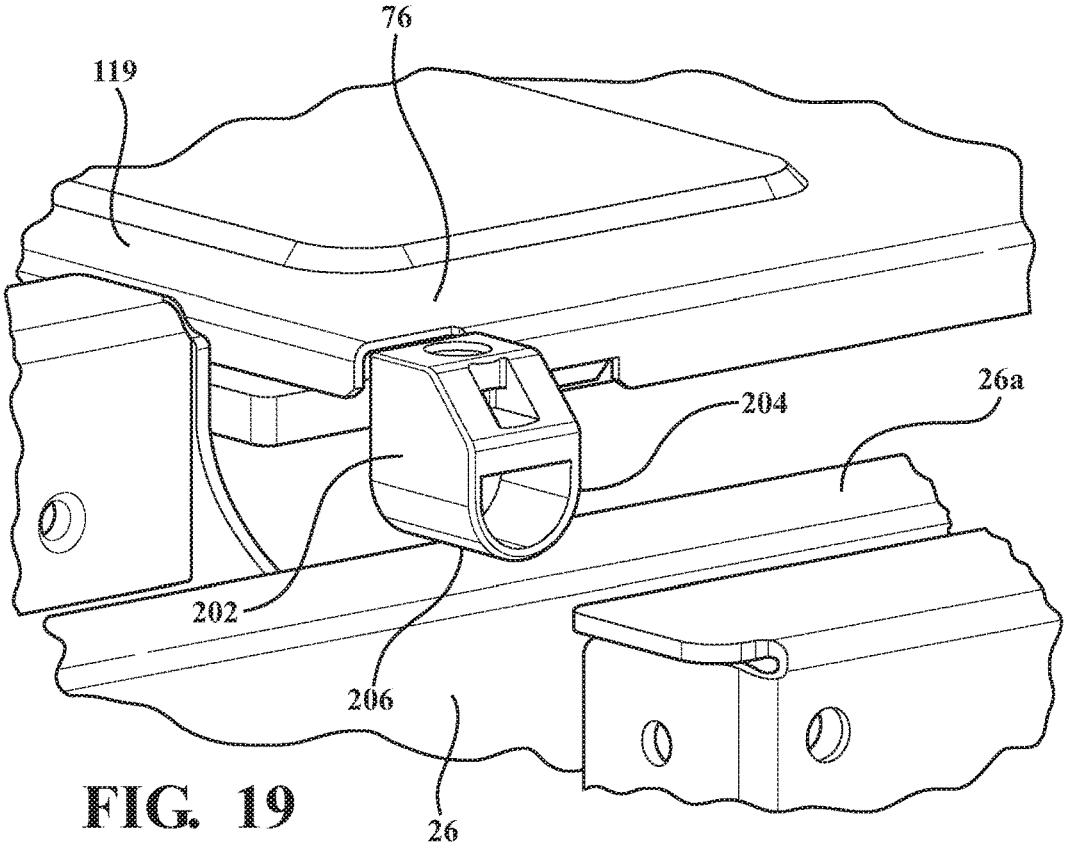
FIG. 19 is a close up perspective view of another portion of FIG. 17.

Referring now to FIGS. 17 and 19, another embodiment of the deck extension assembly 62 is provided in which the one or more stops 100 and the corresponding frame brackets 102 of the support frame 26 and the one or more bearings 104 described above have been replaced by an alternative combination of components employed to prevent the deck extension section 76 from being fully removed when the deck extension assembly 62 is moved from the retracted position (generally represented as shown in FIG. 4A) to the extended position (generally represented as shown in FIG. 4B).

As shown FIGS. 17 and 19, the illustrated deck extension section 76 comprises one or more slide bearings 200 (only one of the slide bearing 200 shown in FIGS. 17 and 19) which are each respectively positioned on the support frame 26. The one or more slide bearings 200 are arranged near the head end 119 of the deck extension section 76, and as such are positioned onto the upper surface 26*a* of the support frame 26 closer to the leg section 30*b* than the bearing block 70 mounted onto the upper surface 26*a*. Accordingly, when the deck extension assembly 62 is moved from the retracted position towards to the extended position (positions generally shown in FIGS. 4A and 4B, as noted above), the slide bearings 200 slide along the upper surface 26*a* of the support frame 26 towards the bearing block 70. At the extended position, the slide bearing 200 contacts the front surface 71 of the bearing block 70, which prevents the further extension of the deck extension assembly 62 relative to the support frame 26.

As is best shown in FIG. 19, the slide bearing 200 has an upper base portion 202 which is mounted to the deck extension section 76 (e.g., with one or more fasteners), and a lower base portion 204 which extends from the upper base portion 202. The lower base portion 204 includes a curved lower surface 206 that contacts the upper surface 26*a* of the support frame 26. Similar to the bearing 68 described above, the slide bearing 200 may be formed at least partially of plastic. For instance, the slide bearing 200 may be formed of polyamides or nylon, high-density polyethylene (HDPE), low-density polyethylene (LDPE), polyethylene terephthalate (PET), polypropylene (PP), high impact polystyrene (HIPS), polyvinyl chloride (PVC), polytetrafluoroethylene (PTFE), combinations thereof, or other suitable plastic materials. The slide bearing 200 may also be formed of other materials, such as metal, combinations of metal and plastic, etc.

Figure 18:
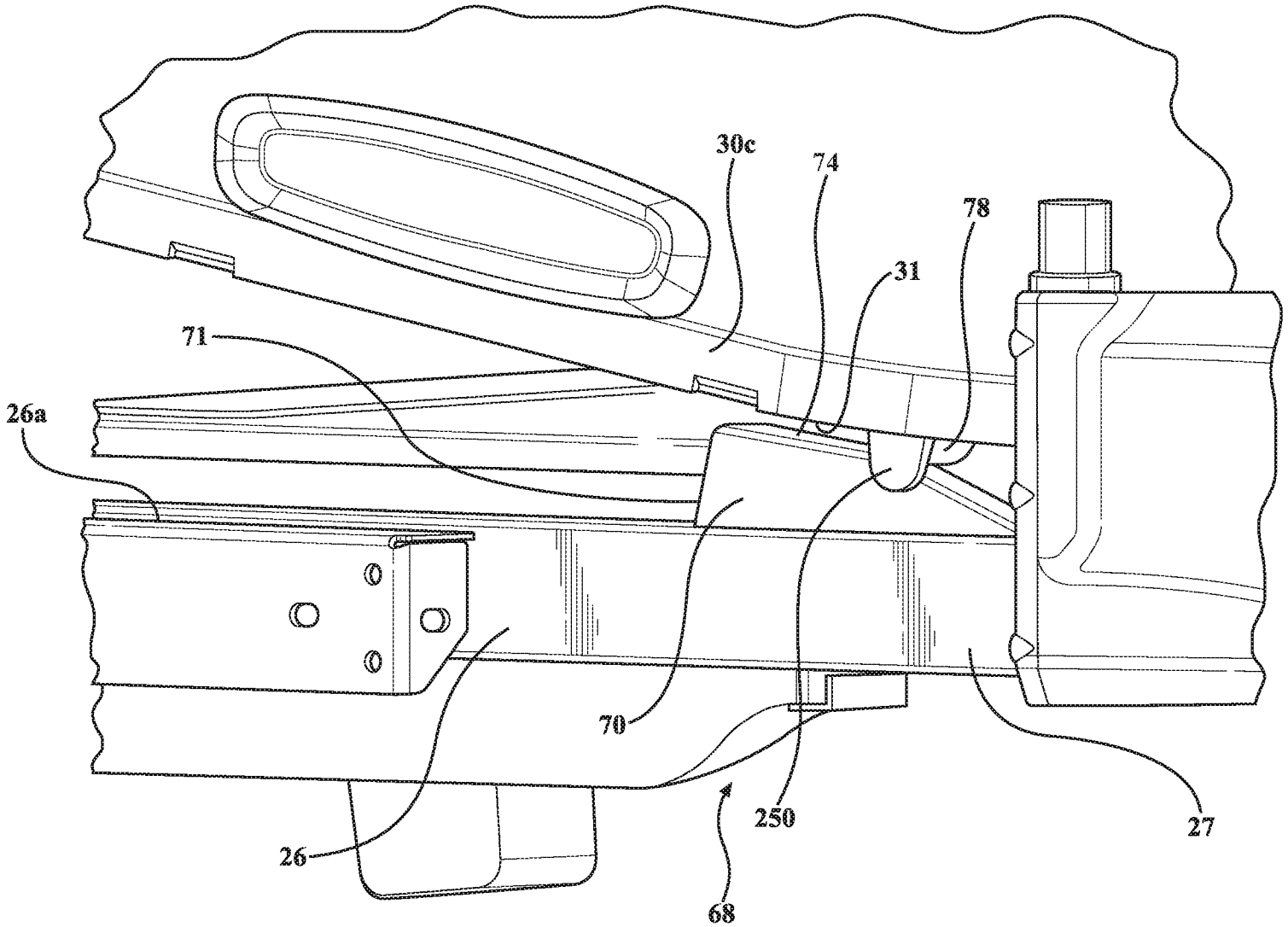
FIG. 18 is a close up perspective view of a portion of FIG. 17.
Figure 20:
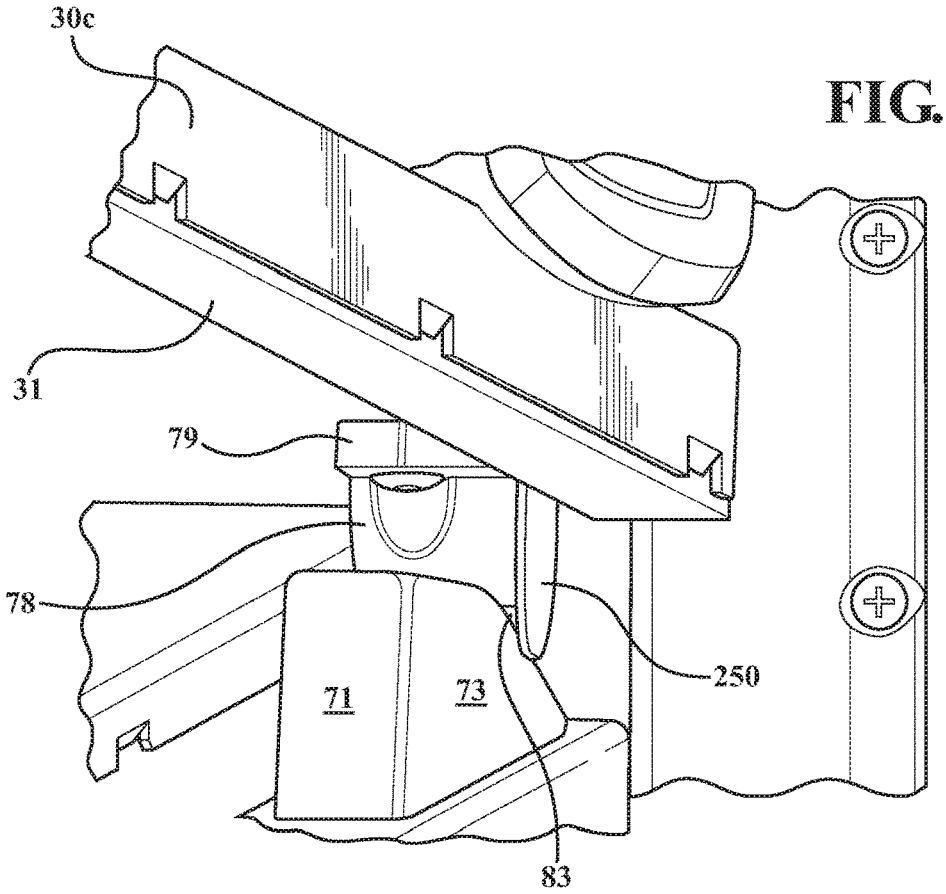
FIG. 20 is a side perspective view of a portion of FIG. 17 showing the shield member coupled to the slider and extending adjacent to the front surface of the bearing block.

Referring now to FIGS. 17-18 and 20, another embodiment of the patient support apparatus 30 is provided in which additional operator protection features are provided for covering the bearing 68 and the one or more sliders 78. More specifically, a shield member 250 is provided to assist in preventing a user (e.g., a caregiver, a patient, an operator, and the like) from having their hand pinched between the bearing block 70 and the slider 78 as the slider 78 slides along the ramp portion 74 when the foot section 30*c* is articulated to and from the raised position. The shield member 250 may be formed integrally with (or otherwise attached to) either the slider 78 or the bottom portion 31 of the foot section 30*c*. Other configurations are contemplated.

As shown in FIGS. 17-18 and 20, in some embodiments, the shield member 250 may be integrally formed with the slider 78, and extends downward beyond the arcuate contact portion 83 so as to be disposed adjacent to the front surface 73 of the bearing block 70. Accordingly, when viewed from the perspective of the patient support apparatus 30 as in FIGS. 17-18, and 20, the slider 78 and the bearing block 70 are arranged internal relative to the shield member 250 such that the shield member 250 covers the slider 78 and bearing block 70 from at least this perspective. The shield member 250 thus covers a potential pinch point between the arcuate contact surface 83 of the moving slider 78 and the ramp portion 74 as the slider 78 rolls along the ramp portion 74.

While the shield member 250 as illustrated in FIGS. 17-18, and 20 is sized and shaped to generally correspond to the size and shape of the slider 78, and thus does not cover the entirety of the front surface 73 of the bearing block 70 as illustrated, it is contemplated that the shield member 250 could be configured with other sizes or shapes while maintaining the functionality of minimizing or otherwise eliminating pinch points, as described above. In particular, it will be appreciated that the shield member 250 could be sized and shaped to generally correspond to (or otherwise extend beyond) the size and shape of the front surface 73 of the bearing block 70. Other configurations are contemplated.

It is to be appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support frame;

a patient support deck carried by the support frame, the patient support deck having a foot section configured to articulate relative to the support frame;

a deck extension assembly comprising an extension frame and a deck extension section, wherein the extension frame and the deck extension section are configured to extend and retract relative to the support frame;

a bearing arranged to act between the deck extension section and the support frame when the deck extension section extends and retracts relative to the support frame, the deck extension section being movably coupled to the extension frame so that the deck extension section is able to move relative to the extension frame and relative to the foot section when the deck extension section extends and retracts relative to the support frame such that the deck extension section maintains contact with the bearing when extending and retracting relative to the support frame.

2. The patient support apparatus of claim 1, wherein the deck extension section is pivotally connected to the extension frame to be able to pivot relative to the extension frame as the deck extension section extends and retracts relative to the support frame.

3. The patient support apparatus of claim 2, wherein the deck extension section comprises a handle to manually pivot the deck extension section relative to the extension frame.

4. The patient support apparatus of claim 1, wherein the bearing comprises a bearing block formed at least partially of plastic, the bearing block being fixed to the support frame.

5. The patient support apparatus of claim 4, wherein the bearing block comprises a base portion and a ramped portion.

6. The patient support apparatus of claim 4, wherein the bearing comprises a second bearing block formed at least partially of plastic, the second bearing block being fixed to the support frame and the bearing blocks being spaced from each other.

7. The patient support apparatus of claim 6, wherein the deck extension section comprises a panel frame and an extension panel mounted to the panel frame, the bearing blocks being arranged to contact the panel frame as the deck extension section extends and retracts relative to the support frame.

8. The patient support apparatus of claim 7, wherein the bearing comprises a third bearing block formed at least partially of plastic and fixed to the support frame, the third bearing block being arranged to contact the extension panel as the deck extension section extends and retracts relative to the support frame.

9. The patient support apparatus of claim 1, wherein the deck extension assembly comprises a pair of telescoping frame members fixed to the extension frame and vertically spaced from the deck extension section, the support frame comprising a pair of support frame members to slidably receive the pair of telescoping frame members.

10. The patient support apparatus of claim 9, comprising a locking mechanism configured to lock the deck extension assembly from extending or retracting relative to the support frame and a release mechanism configured to actuate the locking mechanism to unlock the deck extension assembly.

11. The patient support apparatus of claim 9, wherein the deck extension section comprises a stop arranged to contact the support frame when the deck extension section is fully extended away from the support frame.

12. The patient support apparatus of claim 1, comprising an actuator coupled to the foot section to articulate the foot section relative to the support frame.

13. The patient support apparatus of claim 12, comprising a second bearing arranged to act between the foot section and the support frame when the foot section articulates relative to the support frame.

14. The patient support apparatus of claim 13, wherein the foot section is configured to slide along the second bearing.

15. The patient support apparatus of claim 14, wherein the second bearing comprises a bearing block formed at least partially of plastic, the bearing block being fixed to the support frame.

16. The patient support apparatus of claim 15, wherein the bearing block comprises a base portion and a ramped portion;

wherein the ramped portion has an upper surface profile configured to maintain a gap between the foot section and the deck extension section while the foot section articulates relative to the support frame; and wherein the foot section comprises a slider block configured to slide along the ramped portion of the bearing block.

17. The patient support apparatus of claim 15, wherein the second bearing comprises a second bearing block formed at least partially of plastic, the second bearing block being fixed to the support frame and the bearing blocks being spaced from each other.

18. The patient support apparatus of claim 1, wherein the bearing comprises a slide bearing which is coupled to the deck extension assembly and which is slidingly engaged to an upper surface of the support frame.

19. The patient support apparatus of claim 16, wherein the slider block comprises a base portion and an arcuate contact portion, and wherein the patient support apparatus further comprises a shield member coupled to one of the slider block or the foot section and extending adjacent to a front surface of the bearing block to cover the interface between the arcuate contact portion of the slider block and the ramped portion of the bearing block.

20. A patient support apparatus comprising:

a support frame;

a patient support deck carried by the support frame;

a deck extension assembly comprising an extension frame and a deck extension section, wherein the extension frame and the deck extension section are configured to extend and retract relative to the support frame;

a bearing arranged to act between the deck extension section and the support frame when the deck extension section extends and retracts relative to the support frame, the deck extension section being movably coupled to the extension frame so that the deck extension section is able to move relative to the extension frame when the deck extension section extends and retracts relative to the support frame such that the deck extension section maintains contact with the bearing when extending and retracting relative to the support frame.

* * * * *